US005680651A

United States Patent [19]

Tsuji et al.

[11] Patent Number: 5,680,651

[45] Date of Patent: Oct. 21, 1997

[54] DUPLEX PRINTING APPARATUS

[75] Inventors: Masaru Tsuji, Nara; Akira Nakashima, Soraku-gun; Yoshikazu Kondo, Izumiohtsu, all of Japan

[73] Assignee: Sharp Kabushiki Kaisha, Osaka, Japan

[21] Appl. No.: 646,393

[22] Filed: May 9, 1996

[30] Foreign Application Priority Data

| | | | |
|---|---|---|---|
| May 9, 1995 | [JP] | Japan | 7-110940 |
| May 22, 1995 | [JP] | Japan | 7-122389 |
| Apr. 18, 1996 | [JP] | Japan | 8-097007 |

[51] Int. Cl.[6] ..... G03G 21/00

[52] U.S. Cl. ..... 399/401; 399/406; 271/186

[58] Field of Search ..... 399/401, 406; 271/65, 186, 902; 355/319, 23, 24

[56] References Cited

U.S. PATENT DOCUMENTS

| | | | |
|---|---|---|---|
| 4,650,176 | 3/1987 | Sugizaki et al. | 399/401 |
| 4,928,127 | 5/1990 | Stemmle | 399/401 |
| 5,132,742 | 7/1992 | Goto | 399/401 |
| 5,162,857 | 11/1992 | Higeta et al. | 399/401 |
| 5,166,739 | 11/1992 | Katsuki et al. | 399/401 |
| 5,233,401 | 8/1993 | Sasaki et al. | 399/401 |
| 5,337,134 | 8/1994 | Sato et al. | 399/401 |
| 5,448,348 | 9/1995 | Azeta | 399/401 |

FOREIGN PATENT DOCUMENTS

| | | | |
|---|---|---|---|
| 55-28063 | 7/1980 | Japan . | |
| 58-007656 | 1/1983 | Japan | 355/319 |
| 60-10620 | 3/1985 | Japan . | |
| 60-10621 | 3/1985 | Japan . | |
| 62-186277 | 8/1987 | Japan | 355/319 |
| 62-290640 | 12/1987 | Japan . | |
| 4-151174 | 5/1992 | Japan | 355/319 |

*Primary Examiner*—Matthew S. Smith

[57] ABSTRACT

An object of the invention is to shorten the path of back-side printing, improve the job efficiency, surely correct the curl given by a fixing roller and carry out switching for the back-side printing in a simple configuration. A duplex printing apparatus is provided with a sheet tray installed in a lower portion thereof, and first guiding device installed in one side portion thereof. Second transport path is installed in an upper portion above the first transporting device installed above the sheet tray, and installed in the second transport path are developing/image transferring device, fixing device and third guiding device, in this order from below. Installed substantially in parallel to the first transport path L1 and near one side of the duplex printing apparatus is third guiding device, and installed along the third transport path are fourth guiding device, correcting device, third transporting device and fifth guiding device, in this order from above. Second transporting device and a discharge port are installed on the opposite side of the third guiding from the fourth guiding device in this order.

16 Claims, 21 Drawing Sheets

FIG. 10
FIG. 10A
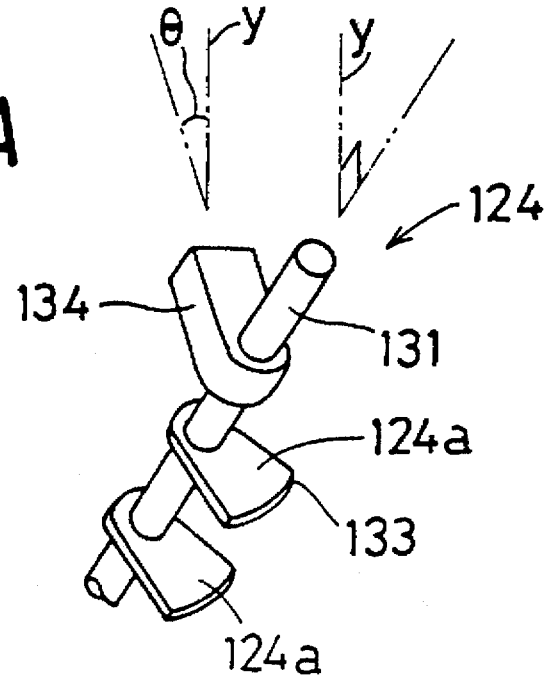
FIG. 10B
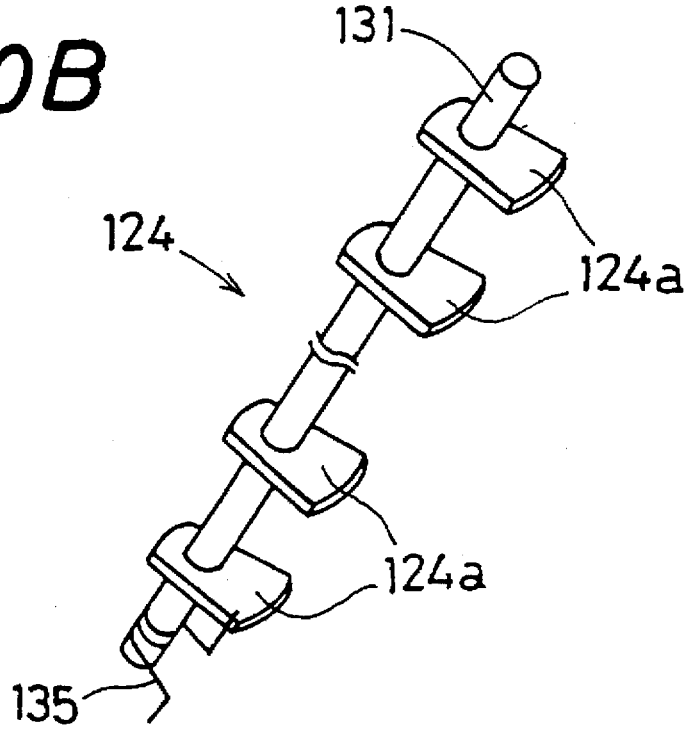

DUPLEX PRINTING APPARATUS

BACKGROUND OF THE INVENTION

1. Field of the Invention

The present invention relates to a duplex printing apparatus which is preferably embodied by using, for example, the electrophotography process, and is capable of printing on both sides of paper sheets.

2. Description of the Related Art

FIG. 22 is a sectional view schematically showing a duplex printing apparatus of the first prior art. A paper tray 3 whereon a plurality of sheets 2 are stacked is located in the lower part of a printing apparatus body 1*a*. Installed in the printing apparatus body 1*a* at a place nearer to one side thereof is a guide plate 13*a*. Sheet 2 is fed from the front edge of the sheet tray 3 in the sheet feeding direction A, guided by the guide plate 13*a* to be inverted and fed onto a transport roller 4. Installed above the sheet tray 3 are a photosensitive drum 5 and a fixing roller 6 being arranged in this order in the opposite direction to the sheet feeding direction A. The sheet 2 fed from the transport roller 4 is first processed on the photosensitive drum 5 where toner used as a developing agent is transferred onto the sheet 2. Then the developing agent which has been transferred is fixed onto the sheet 2 by the fixing roller 6.

Installed in the path of the sheet 2 after fixing is a switching claw 8. When printing an image on one side of the sheet 2, the sheet 2 is sent over the fixing roller and discharged by a discharge roller 7 provided in the upper part of the printing apparatus body 1*a* through a discharge port 7*a* to the outside. In case images are to be printed on one and other sides of the sheet 2 and an image is to be printed on back side of the sheet, the sheet 2 is guided to a transport roller 9 by the switching claw 8 installed in the path of the sheet 2 which has been fixed. The transport roller 9 once sends the sheet 2 out of the printing apparatus body 1*a* from an upper part thereof. After sending out the sheet 2, rotating direction of the transport roller 9 is reversed. This causes the sheet 2 to return into the printing apparatus body 1*a* and to be fed into a back side printing path. A switching claw 10 is installed below the transport roller 9 in order to prevent the sheet 2 of which transport direction has been reversed from returning into the former path.

The sheet 2 guided by the switching claw 10 is sent into a lower part of the duplex printing apparatus 1 by a transport roller 11 installed at the back of the sheet tray 2. The sheet 2 transported by the transport roller 11 is guided toward below the sheet tray 3 in the feeding direction A by a guide roller 11*a* installed in a lower part of the printing apparatus body 1*a*. Installed below the sheet tray 3 are a transport roller 12 and a transport roller 13 arranged in this order in the feeding direction A. The sheet 2 guided by the guide roller 11*a* is sent via the transport roller 12 to the transport roller 13. When sent from the transport roller 13, the sheet 2 is guided by a guide plate 13*a* from the front edge of the sheet tray 2 to the transport roller 4 again, where the back printing path ends and the subsequent printing on the back side is carried out.

The switching claws 8, 10 are each constituted from an electromagnetic solenoid, with the individual motions being controlled. The sheet 2 is caused to warp by the fixing roller 6, into a so-called curled condition. Therefore, in the duplex printing apparatus 1, the sheet 2 is formed in a corrugated shape by a plurality of rollers arranged in the back-side printing path, thereby to correct the curling.

Second prior art is disclosed in the Japanese Unexamined Patent Publication JPA 62-290640. FIG. 23 is a sectional view showing an image forming apparatus 14 of this prior art. Sheet 17 is fed from a sheet feeding section 15 in sheet feeding direction B by the rotation of a sheet feeder roller 16. The sheet 17 is sent from the sheet feeding section 15 to a copying section 19 by a resist roller pair 18 installed in the sheet feeding direction B.

First a toner image is transferred onto the sheet 17 in the copying section 19. Then the sheet 17 is transported in the sheet feeding direction B by a transport belt 20 while the toner image is fixed when the sheet 17 passes a fixing section 22. In the case of copying on one side only, the sheet 17 passes a transport roller pair 23 and is guided by a refeeding flapper 24 to pass a discharge roller 25 to be discharged onto a tray 26.

In the case of duplex copying or overlay copying, the refeeding flapper 24 is switched to such a direction that blocks the feeding direction B. This causes the sheet 17 sent from the transport roller pair 23 to be guided in a refeeding path 27 where the sheet 17 is guided in the direction opposite to the feeding direction B by the refeeding flapper 24. The refeeding path 27 is inclined downward in the downstream direction of sheet feeding from below the transport roller pair 23 to below the resist roller pair 18. The sheet 17 passes through the refeeding path 27 and is sent to one end of upper side of an intermediate discharge section 28 which guides the sheet 17.

The intermediate discharge section 28 is provided with a flapper 29 on one end on the upper side thereof and a flapper 30 in an intermediate portion. Also installed below the intermediate discharge section 28 is an intermediate tray 31 disposed substantially in parallel with the intermediate discharge section 28. Arranged on the other end in the lower part of the intermediate discharge section 28 is an inverting path 32 being directed toward one end on the downstream side of the intermediate tray 31.

In the case of copying on both sides, the sheet 17 is first guided by the flapper 29 and the flapper 30 thereby to be transported along top surface of the intermediate discharge section 28. Then the sheet 17 is inverted by an inverting path 32 and, after being held between a curling roller pair 35, stacked on the intermediate tray 31 with the side of image facing upward.

In the case of overlay copying, the sheet 17 is guided by a refeeding flapper 24 and transported toward the refeeding path 27. When the sheet 17 is a large-sized sheet, the sheet 17 is guided by the flapper 29 and, after being held between the curling roller pair 33, stacked on the intermediate tray 31 with the side of image facing downward. When the sheet 17 is a small-sized sheet, the sheet 17 is transported along the top surface of the flapper 29 by the switching between the flapper 29 and the flapper 30. Then after being guided by the flapper 30 and held between the curling roller pair 34, the sheet 17 is stacked on the intermediate tray 31 with the side of image facing downward.

When a specified number of sheets 17 are stacked on the intermediate tray 31, the sheets 17 are separated one sheet after another by separating means 36 installed below the intermediate tray 31, and is sent from the intermediate tray 31 into the refeeding path 37. The sheet 17 is transported along the refeeding path 37 going upward, then passes the resist roller pair 18 to be fed to the copying section 19 again. In the copying section 19, toner image is transferred onto the back side of the sheet 17 in the case of duplex copying, or toner image is transferred on the same side as before in the case of overlay copying. Then the sheet 17 is transported by the transport belt 20 to the fixing section 22 where the toner image is fixed, then the sheet 17 is discharged onto the tray 26.

The curling roller pairs 33, 34, 35 are installed for the purpose of forming curls on both edges of the sheet 17 in the direction of width thereby increasing the apparent rigidity of the sheet.

In the duplex printing apparatus 1 of the first prior art, back-side printing is carried out by controlling the switching claws 8, 10 to send the sheet 2 from the back of the sheet tray 3 through under the sheet tray 3 forward, then send the sheet 2 to the transport roller 4 again. Consequently, because the two switching claws 8, 10 must be controlled, the control mechanism becomes complex and a large number of component parts are required. Also the transport path for back-side printing is longer because the path passes below the sheet tray 3. Therefore, it takes a long time to reverse the rotating direction of the transport roller 9 and transporting the sheet 2 to a position where printing is done again, resulting in lower job efficiency.

Further, the duplex printing apparatus 1 is provided with a back-side printing path below the sheet tray 3. Therefore, in case the back-side printing path is jammed, it is difficult to remove the jam. To remove jam, it is necessary to pull out the sheet tray 3 or lift up the printing apparatus body 1*a*. And curling of the sheet 2 is corrected by disposing a plurality of transport rollers in an undulating arrangement in the back-side printing path. This correcting process is effective in case the transport path is long, but is not so effective in case of a short path.

In the image forming apparatus 14 of the second prior art, the resist roller pair 18, the copying section 19, the transport belt 20 and the fixing section 22 are installed substantially horizontally from the sheet feeding section 15 in the sheet feeding direction B. This configuration makes the apparatus large in size. Also because the three flappers 24, 29 and 30 must be controlled, the control mechanism becomes complex. Further, the curling roller pairs 33, 34, 35 form curls on both edges of the sheet 17 in the direction of width to increase the rigidity of the sheet 17. These roller pairs are not intended to correct curls caused by the fixing roller 22.

Also in the duplex printing apparatus described above, transfer of toner image and fixing operation are repeated two or more times. This printing operation is carried out in either simplex printing mode wherein toner image is printed on only one side of the sheet, or in duplex printing mode wherein toner images are printed on one and other sides of the sheet. In case the simplex printing mode is selected, it is difficult to switch the mode to duplex printing mode while transport and fixing operations are being carried out in the duplex printing mode plural times. It is difficult to switch the mode to the simplex printing mode, in contrast to the above, while the transport and fixing operations are being carried out plural times. Therefore, to switch the printing mode in these apparatuses, the transport and fixing operations in the current mode are once stopped and then transfer and fixing operations in the other mode are started.

Printing apparatuses which are capable of switching the mode in the course of printing are disclosed in Japanese Examined Patent Publications JP-B2 60-10620, JP-B2 60-10621 and JP-B2 55-28053. In the third prior art disclosed in Japanese Examined Patent Publication JP-B2 60-10620, it is possible to switch the mode to simplex printing during duplex printing operation, although it requires to add a discharging device having an inverting transporting path to the apparatus. This results in an increased number of component parts and larger size of the apparatus. In the fourth and the fifth prior arts disclosed in JP-B2 60-10621 and JP-B2 55-28053, it is possible to switch the mode to simplex printing during duplex printing operation, although in this switching operation, a sheet with an image printed on one side thereof is once stored in a storage device such as buffer tray and intermediate storage device, and is then discharged onto a discharge tray. This results in an increased number of component parts and larger size of the apparatus.

Further another duplex printing apparatus of the sixth prior art will be described below. In this duplex printing apparatus, operations of transferring and fixing toner image on sheets are repeated plural times in the duplex printing mode. At this time, the sheets are discharged with the side whereon the toner image was printed first facing upward. Consequently, in this apparatus, even-numbered pages and odd-numbered pages of the discharged sheets are not collated in order at the time they are discharged. Thus the user must collate the sheets in the correct order of pages with hand upon completion of printing.

In case the sheet is discharged with the side whereon the toner image was printed later facing upward, on the contrary, when the number of toner images to be printed, namely the number of pages, is an odd number, only the last page faces differently from other pages. In order to have the pages collated in the correct order in such a case, it is necessary to pass the last sheet through the toner image transfer and fixing path again even when no image is to be printed on the other side of the last sheet. Components constituting the image transfer means and the fixing means are often contaminated with toner or other. Therefore, a sheet passing this path may have its blank side contaminated.

SUMMARY OF THE INVENTION

An object of the present invention is to provide a duplex printing apparatus wherein the path for back-side printing is made shorter to improve the job efficiency. Another object of the invention is to provide a duplex printing apparatus capable of surely correcting curls of sheets caused by the fixing roller and capable of changing over to the path for back-side printing with a simple configuration.

The present invention provides a duplex printing apparatus comprising:

sheet feeding means for housing a plurality of paper sheets so that a stack of the plurality of paper sheets is formed and feeding the uppermost paper sheet of the stack in a sheet feeding direction toward one side of the main body of the duplex printing apparatus when printing is started, the sheet feeding means being disposed at a lower part of the main body;

first guiding means for guiding the paper sheet fed by the sheet feeding means into a first transport, the first guiding means being disposed at a position nearer to the one side of the main body and including a guiding plate in which a first guiding plane for inverting; the sheet flow to a first transport direction opposite to the sheet feeding direction is formed along the first transport path and the top face of which extends along the first transport path;

second guiding means in which a second guiding plane is formed to guide the sheet which is inverted by the first guiding means and transported in the first transport direction, into a second transport path arranged substantially in parallel with the one side of the main body;

first transport means for transporting the sheet inverted by the first guiding means to second guiding means, disposed in the first transport path;

developing and image transferring means for forming a toner image on one side of the sheet transported along the second transport path at an image transferring position;

fixing means for fixing the toner image formed on the one side of the sheet, disposed in the second transport path and arranged above the image transferring position;

third guiding means arranged above the fixing means and having a third guiding plane which guides the sheet transported from the fixing means along the second transport path, in the sheet discharging direction opposite to the sheet feeding direction along a sheet discharging path connected to a sheet discharging port formed in an upper part of the main body;

second transport means disposed in the sheet discharging path on the downstream side of the third guiding means in the sheet discharging direction and having a first drive roller which is driven to rotate selectively in either a first rotating direction corresponding to the sheet discharging direction or a second rotating direction opposite to the first rotating direction and a driven roller which is in contact with the first drive roller to be driven to rotate;

a rotation drive source for driving the first drive roller to rotate selectively in either the first rotating direction or the second rotating direction;

fourth guiding means for guiding the sheet which is transported by the second transport means from the sheet discharging path over the third guiding means in the refeeding direction opposite to the sheet discharging direction, into a third transport path provided substantially in parallel with the second transport path and nearer to the one side of the main body than the second transport path; and fifth guiding means for guiding the sheet which is transported along the third transport path in the third transport direction opposite to the second transport direction along the second transport path, into a direction which is inclined downward to the downstream of the first transport direction as approaches the first transport path, and transporting the sheet to the first transport path.

According to the invention, the duplex printing apparatus conduct printing of images on at least either one or the other side of the sheet. The sheet is firstly fed from the feeding means in a feeding direction and is, after being inverted by the first guiding means to the direction opposite to the feeding direction, guided to the first transport means. The sheet is transported by the first transport means along the first transport path and then guided by the second guiding means into the second transport path which goes upward through the apparatus.

In the second transport path, a toner image is firstly transferred onto the sheet by the developing and image transferring means. Then the toner image is fixed onto the sheet by the fixing means. Thus the image is printed on one side of the sheet. After the toner image is fixed, the sheet is transported from the fixing means toward the third guiding means. The transported sheet is guided into the sheet discharge path along the guiding plane of the third guiding means.

When printing an image on one side of sheets, the sheet is guided along the sheet discharging direction to the second transport means. At this time the first drive roller of the second transport means is driven by the rotation drive source to rotate in the first rotating direction which corresponds to the sheet discharging direction. This causes the sheet to be discharged from the sheet discharge port to the outside.

In case of printing an image on one side of sheet and then printing an image on the other side of the sheet, the first drive roller is switched from the first rotating direction to the second rotating direction in the course of discharging the sheet. The second rotating direction is opposite to the first rotating direction and corresponds to the refeeding direction. While the roller rotates in the first rotating direction, the sheet is discharged from the downstream end in the discharging direction to the outside through the discharge port. When it is detected by detecting means that an edge of the sheet on the upstream side in the discharging direction has passed the third guiding means, rotation of the first drive roller is switched to the second rotating direction.

The above operation causes the sheet to be transported over the third guiding means in the refeeding direction. At this time, the direction of sheet transport is reversed from the former transport direction. The transport direction of the sheet is bent about 90 degrees by the fourth guiding means, so that the sheet is guided by the third transport path which is inclined downward through the apparatus thereby to be transported through the path. The sheet transported through the third transport path is guided by the guide plate of the first guiding means via the fifth guiding means. The fifth guiding means bends the direction of transporting the sheet about 90 degrees, so that the sheet is transported in a direction substantially parallel with the bottom surface of the apparatus. The sheet of which transport direction has been bent is transported into the first transport path again.

At the time the sheet has arrived at the first transport path by the fourth and fifth transport means and the third transport path, the front and back sides of the sheet are inverted. The sheet is transported by the first transport means again along the first transport path in the first transport direction. Thus an image is printed on the back side of the sheet by the developing and image transferring means and the fixing means. After printing the image, the sheet is discharged, via the third guiding means, by the second transport means through the discharge port to the outside.

When printing on the back side while inverting the sheets one by one, the time taken to transport the sheet to the developing and image transferring means again after inverting the sheet up side down has a great effect on the job efficiency. The shorter the time taken in the transportation, the higher the job efficiency. According to the invention, therefore, the back-side printing path which has been provided below the sheet feeding means in the prior art is installed as the discharge path and the third transport path above the feeding means. This shortens the path and reduces the time taken to transport the sheet, thereby improving the job efficiency.

Further according to the invention, the third transport path is installed at a position nearer to the one side of the main body. In the case of jamming in the back-side printing path, the jam must be removed by taking out the sheet tray or lifting the printing apparatus body in the prior art, but in the apparatus of the invention, jamming can be removed easily by accessing from the side of the apparatus.

According to the invention, as described above, the third transport path which corresponds to the back-side printing path installed below the feeding means in the prior art is installed at a position nearer to one side of the apparatus in parallel with the second transport path which is a printing path substantially parallel to the one side of the apparatus. This makes it possible to shorten the transport path and improve the job efficiency. Also because the third transport path is provided at a position nearer to the one side of the main body, jam can be easily removed from the one side of the main body even when jamming occurs.

The invention is characterized in that:

the third guiding means is disposed above the fixing means and includes an oscillating piece which is angularly displaced by being pressed against a sheet fed from the fixing means along the second transport path, and a support member for supporting the oscillating piece, the third guiding plane is formed on the oscillating piece, the support member supports from below the vicinity of the end of the oscillating piece on the downstream side in the discharging direction along the third guiding plane, an oscillating piece detecting means for detecting the angular displacement of the oscillating piece is further provided, and the first drive roller of the second transport means is driven to rotate selectively in either the first rotating direction or the second rotating direction in response to an output of the oscillating piece detecting means.

According to the invention, the third guiding means includes the oscillating piece and the support member. When the sheet does not reach the third guiding means, one end of the oscillating piece is supported by the support member from below. This end is the end on the downstream side in the discharging direction of the third guiding plane which is formed subsequent to the second transport path. The third guiding plane follows the second transport path that goes up substantially in parallel with the side face of the apparatus, and bends the direction of transporting the sheet transported along this plane by 90 degrees.

When a sheet whereon a toner image has been fixed reaches the third guiding means from the second transport path, the leading edge of the sheet comes into contact with the third guiding plane of the oscillating piece from below. The oscillating piece is pressed by this sheet thereby to make an angular displacement, causing a gap between the oscillating piece and the support means. The sheet is, while pressing up the oscillating piece, transported along the third guiding plane. When the sheet passes the third guiding means, the force of pressing up the oscillating piece is lost, so that the oscillating piece returns to the initial state by the dead load thereof. Consequently, the contact point between the second transport path and the sheet discharging path is interrupted by the tip of the oscillating piece.

The duplex printing apparatus of the invention detects the angular displacement of the oscillating piece with detecting means. In response to the angular displacement of the oscillating piece, the first drive roller is driven to rotate in either the first or the second rotating direction.

In the duplex printing apparatuses of the prior art, switching of the back-side printing path is carried out by controlling a plurality of switching claws which are activated by electromagnetic solenoids or the like. According to the present invention, switching of the transport path is carried out by means of the oscillating piece of the third guiding means which makes angular displacement by the force generated by the transport of a sheet and its own dead load. Also the passing of the sheet is detected at the same time by means of the detecting means which detects the angular displacement of the oscillating piece. Thus the number of component parts is reduced and therefore the configuration of the apparatus can be simplified and the cost can be reduced.

According to the invention, it is selected whether the back-side transport path is to be used or not, by means of the oscillating piece which makes an angular displacement by the force generated by the transport of a sheet and the gravity. In the apparatus of the prior art, this selecting operation has been carried out by controlling a plurality of switching claws which are actuated by electromagnetic solenoids or the like. Compared to apparatuses of the prior art, as described above, the apparatus of the invention does not require complicated control process and is therefore capable of stable switching of the transport path. Further, angular displacement of the oscillating piece is detected with detecting means of simple configuration while passing of the sheet is detected at the same time. This makes it possible to reduce the number of component parts required for switching of the transport path. Thus the configuration of the apparatus can be simplified and the cost of the apparatus can be reduced.

The invention is characterized in that:

the fixing means includes a pressure roller installed on the third transport path side of the second transport path and a thermal roller to be heated to a predetermined fixing temperature, installed on the opposite side of the second transport path from the pressure roller, and correcting means is provided, which has a second drive roller installed at a position which is in proximity to the fixing means and is on the side of the one side of the main body of the third transport path, and a plurality of first correcting rollers contacting with the second drive roller, installed on the second transport path side of the third transport path.

According to the invention, the second and the third transport paths are formed substantially in parallel with the side face of the apparatus. In the third transport path, correcting means is installed at a position in proximity to the fixing means of the second transport path. The correcting means comprises the second drive roller and a plurality of first correcting rollers which come into contact therewith. Consequently, a sheet which is warped toward the thermal roller by the fixing means is sent while being wound around part of the second drive roller by the first correcting rollers so that the sheet warps in the opposite direction to the curl. Therefore, in the correcting means, the sheet is warped in the opposite direction to the curl caused by the fixing means while receiving heat from the fixing means. Thus the curl can be surely corrected.

According to the invention, as described above, the correcting means comprising the second drive roller and the plurality of first correcting rollers are installed at a position facing the fixing means. Curling degree of the sheet becomes more significant as the sheet temperature increases. Because the sheet is heated at the fixing means, the curling degree is greater compared to a case where the sheet is not heated. Thus the degree of curl to be corrected increases. When the correcting means is installed at the position described above, heat radiated from the fixing means can be applied to the sheet which has been curled by the fixing means. Therefore, the degree of curl given to a sheet by the correcting means can be increased without providing additional heating means to the correcting means. Thus curl can be corrected reliably.

The invention is characterized in that:

the fixing means includes a pressure roller installed on the third transport path side of the second transport path and a thermal roller to be heated to a predetermined fixing temperature installed on the opposite side of the second transport path from the pressure roller, and the first drive roller of the second transport means is installed at an upper position with respect to the sheet discharge path and the driven rollers, and a plurality of driven rollers are installed to come into contact with the first drive roller from below.

According to the invention, the first drive roller of the second transport means is installed over the second transport path. Further, plural driven rollers which come into contact with the first drive roller from below are provided. Therefore, sheet which has been curled by the fixing means toward the thermal roller is wound around a part of the first drive roller by the second correcting rollers so that the sheet is warped in the direction opposite to the curl. Consequently, the curl formed by the fixing means is corrected by the first drive roller and the second correcting rollers.

When the first drive roller rotates in the second rotating direction for back-side printing, one edge of the sheet on the downstream side in the refeeding direction, namely the tail edge, is directed upward as the sheet is moved downstream in the refeeding direction by the first drive roller and the second correcting rollers. Consequently, the sheet which is fed in the refeeding direction by rotation in the second rotating direction is surely guided to the upper position of the third transport path. Therefore, the sheet with an image printed on one side thereof is prevented from being sent between the oscillating piece and the support member again into the second transport path.

According to the invention, as described above, the second transport means is provided with the first drive roller and the plurality of second correcting rollers. This makes it possible to correct curls even on sheets with an image printed on only one side thereof. Also when sheet is sent by the first drive roller toward the fourth guiding means, tail edge of the sheet is directed upward and guided to the upper position of the third guiding means. Therefore, the sheet is prevented from being sent to the second transport path again or being caught by the oscillating piece causing jam.

The invention is characterized in that:

the fixing means includes a pressure roller installed on the third transport path side of the second transport path or on the opposite side of the second transport path from the third transport path and a thermal roller to be heated to a predetermined fixing temperature installed on the opposite side of the second transport path from the pressure roller, and correcting means is further provided, which has a correcting roller installed on the side of the one side of the main body of the third transport path, and holding means for holding the correcting roller, bringing the correcting roller into contact with the roller of the fixing means installed on the third transport path side of the second transport path and driving the correcting roller to rotate.

According to the invention, the second and the third transport paths are formed substantially in parallel with the side face of the apparatus. The fixing means formed on the second transport means includes the pressure roller and the thermal roller which oppose each other interposing the second transport path and come into contact. A toner image transferred by the developing and image transferring means is fixed by the contact pressure of the roller pair after the toner is melted by the thermal roller which is heated to the fixing temperature.

The third transport path is provided with the correcting roller installed at a position nearer to the one side of the main body. The correcting roller is held by the holding means to contact with one roller, which is installed between the second and third transport paths, among the pair of rollers of the fixing means. With this arrangement, the correcting roller is driven to rotate according to the rotation of one of the rollers. A sheet passing between the correcting roller and the roller installed on the third transport path side of the second transport path is caused to curl in the direction opposite to the curl made by the roller pair of the fixing means. Consequently, these curls cancel each other to remove the curl of the sheet. The correcting rollers and one of the rollers also serve as transport means for transporting the sheet along the third transport path.

The arrangement of the transportation and correction of curl utilizes the rotation of the rollers of the fixing means. Therefore, it is not necessary to install an additional arrangement for driving the correcting roller to rotate. This makes it possible to omit component elements such as rotation drive source, gear and belt for that purpose.

According to the invention, as described above, there is no need for an arrangement of driving the correcting roller to rotate. Because this arrangement can be omitted, number of component parts of the apparatus can be further reduced. Consequently, the apparatus can be made small in size and the manufacturing cost of the apparatus can be reduced.

The invention is characterized in that the holding means further includes adjusting means for pressing the correcting roller in the direction of coming into contact with the roller of the fixing means, installed on the third transport path side of the second transport path, and adjusting the contact pressure between the correcting roller and the roller of the fixing means, installed on the third transport path side of the second transport path.

According to the invention, the holding means has adjusting means which adjusts the contact pressure between the correcting rollers and the roller of the fixing means installed on the third transport path side of the second transport path. The adjusting means presses the correcting rollers in the direction of coming into contact with one of the rollers of the fixing means, thereby to adjust the contact pressure.

When a sheet passes through a pair of rollers, the degree of the curl applied to the sheet increases as the contact pressure of the roller pair increases. The correcting means of the invention applies a curl in the reverse direction to the curl made by the roller pair of the fixing means, thereby to cancel out the curl. Therefore, it is preferable for the roller pair of the correcting means comprising the correcting rollers and one of the rollers to apply a curl of almost equal degree but in the reverse direction to the curl made by the roller pair of the fixing means. Because the correcting means of the invention is capable of freely changing the contact pressure of the roller pair, curling degree can be adjusted easily. Thus correction of curl can be done more accurately.

According to the invention, as described above, contact pressure of the roller pair is adjusted to adjust the degree of the curl applied to the sheet. Therefore, because curl can be corrected more accurately, it is possible to carry out duplex printing with almost no curl on the sheets.

The invention is characterized in that the correcting means further includes heating means for heating the correcting rollers to the predetermined temperature.

According to the invention, the correcting means further includes the heating means which heats the correcting rollers to the predetermined temperature. When a sheet passes through a pair of rollers, the degree of the curl applied to the sheet increases as the roller temperature increases. Because the fixing means must melt the toner, at least one of the rollers is heated. In the apparatus of the invention, correcting rollers can also be heated individually to adjust the temperature. Thus correction of curl can be carried out more reliably.

Also because the correcting rollers come into contact with the pressure roller, heat of the pressure roller may probably be removed to lower the temperature thereof. When temperature of the roller pair of the fixing means lowers, there may arise troubles in melting of the toner and fixing of image. The correcting means of the invention is capable of preventing the removal of heat from the pressure roller because the correcting rollers are also heated. Therefore, failure of fixing a toner image in the fixing means can be prevented from occurring. Thus quality of printed images can be maintained at a high level.

The invention is characterized in that the correcting means further includes a cleaning roller for removing foreign matters sticking onto the correcting rollers by being brought into contact with the correcting rollers and being driven to rotate.

According to the invention, the correcting means has a cleaning roller for removing foreign matters sticking onto the correcting rollers. The cleaning roller cleans the surfaces of the correcting rollers by bringing into contact therewith and being driven to rotate. The correcting rollers contact the side of a sheet whereon an image is printed. And the transport path from the fixing means of the second transport path to the correcting roller in the third transport path is short. As a result, contact surfaces of the correcting rollers may be contaminated by the image just fixed.

In the apparatus of the invention, the surfaces of the correcting rollers which come into contact with the sheet are constantly cleaned by the cleaning roller. Consequently, the correcting rollers can be prevented from being contaminated. It is also possible to prevent such a trouble that contamination on the surfaces of the correcting rollers which come into contact with sheet is transferred to another sheet thereby contaminating the printed face of the sheet. Thus contamination of the correcting rollers is prevented from being transported to a sheet to be printed. Therefore, the quality of printed images can be maintained at a high level.

The invention is characterized by further comprising third transport means provided with a third drive roller installed in the third transport path, which is driven by the rotation drive source to rotate in a third rotation direction corresponding to the third transport direction, while to which the rotation drive force in the opposite direction to the third rotation direction is shut off.

According to the invention, the third drive roller is driven by the rotation drive source to rotate in the third rotating direction corresponding to the third transport direction. The rotation drive source is used to make the first drive roller of the second transport means to rotate, as described above. With this configuration, the first drive roller and the third drive roller can be driven with the single drive source.

In case the leading edge of sheet being transported on the third transport path is transported through the first transport path, the second transport path and the discharge path, then discharged through the discharge port by the second transport means, and the tail edge of the sheet is engaged by the third transport means, the third drive roller is given a force to rotate in the opposite direction to the third rotating direction by the rotation drive source. At this time, rotation drive force for the third drive roller to rotate in the direction opposite to the third rotating direction is shut off. This makes it possible to prevent the tail edge from being sent to the reverse direction while discharging the leading edge of the sheet. Thus the sheet can be smoothly transported and discharged.

According to the invention, as described above, the third drive roller shuts off the rotation drive force in the direction opposite to the third rotating direction among the rotation drive force from the drive source. This configuration prevents a sheet from being pulled to opposing directions by the first drive roller and the third drive roller which are driven by the common drive source. Consequently, the first drive roller and the third drive roller can be driven by a single drive source. Therefore, number of component parts of the apparatus is reduced to make the apparatus in a simpler configuration. Moreover, control is made easier and the main body can be made smaller.

The invention is characterized in that:

a manual sheet feeding port opening toward the outside is provided at a position in the one side of the main body, facing to the first transport direction, the fifth guiding means includes:

a lower oscillating member having a base portion pivoted so as to freely oscillate at an interval upward from the top face of the guiding plate of the first guiding means, and a suspended portion extending from the base portion in a direction of approaching the top surface;

an upper oscillating member having a fixed end pivoted over the lower oscillating member so as to freely oscillate about an axial line parallel to the lower oscillating member and a free end formed near an upper part of the lower oscillating member; and means for energizing the upper oscillating member in such a direction that the free end thereof approaches the third transport path, a contact surface facing the free end of the upper oscillating member is formed above the lower oscillating member, and an arc-shaped support surface is formed at the free end of the upper oscillating member.

According to the invention, the fifth guiding member includes the lower oscillating member, the upper oscillating member and the energizing means. The upper oscillating member is energized by the energizing member to block the third transport path. When a sheet transported along the third transport path passes the fifth transport means, the free end of the upper oscillating member makes an angular displacement in a direction to depart from the third transport path by resisting the energizing means. The lower end of the support surface of the upper oscillating member supports an area, which departs from the third transport path beyond the axial line, of the contact surface of the lower oscillating member thereby to prevent the suspended portion of the lower oscillating member from making an angular displacement in the direction of approaching the first transport means.

Thus the sheet is firstly guided by the upper and lower oscillating members and transported in a direction substantially parallel to the side face of the apparatus. Then the sheet is guided by the top surface of the guide plate of the first guiding means which extends substantially in parallel to the bottom surface of the apparatus via the suspended portion of the lower oscillating member. With this configuration, the sheet is surely guided by the first transport means without coming beyond the upper portion of the first transport means. In case the sheet is not transported on the third transport path, the upper oscillating member is energized in the direction of approaching the third transport path. Consequently, the lower oscillating member is free to make angular displacement during this period. Therefore, when a sheet is sent by manual feeding through the manual feed port, the sheet can be sent smoothly to the first transport means without obstructing the sheet.

According to the invention, as described above, the fifth transport means guides the sheet transported along the third transport path, to the first transport means. This makes it possible to avoid sending the sheet over the first transport means. Therefore, sheets can be transported smoothly without causing jam, and can be printed on the back side thereof. Also when a sheet is fed by manual feeding through the manual feed port, the lower oscillating member installed to be free to make angular displacement makes an angular displacement thereby opening the path widely. Therefore the sheet can be fed smoothly to the path, making it possible to improve the operability. Also because sheets can be fed to three transport paths by using a small space, the apparatus can be made smaller in size.

The invention is characterized in that sheet feed detecting means is provided, which has an actuation piece which freely retracts and projects above the guiding plate and is installed on upstream side of the first transport means in the first transport direction, and outputs a sheet feed detection signal in response to tilting of the actuation piece.

According to the invention, the actuation piece of the sheet feed detecting means is installed projecting above the guiding plate which is installed on the upstream side of the first transport means in the first transport direction. With this arrangement, at least a sheet which is fed from the feeding means and guided by the first guiding means reaches the first transport means after the actuation piece is tilted. A sheet transported along the third transport path and guided by the fifth guiding means also reaches the first transport means after the actuation piece is tilted. Further, a sheet fed from the manual feed port also reaches the first transport means after the actuation piece is tilted. Thus in case the actuation piece of the sheet feed detecting means is installed as described above, a sheet reaching the first transport means is surely transported to the first transport means via the actuation piece regardless of the path taken. Consequently, a sheet can be detected by a single actuation piece regardless of in which direction the sheet has been fed.

According to the invention, as described above, the actuation piece of the sheet feed detecting means is installed between the first transport path and the fifth guiding means. This makes it possible to detect by means of a single actuation piece that a sheet has been fed, from whatever direction the sheet is fed. Thus because a single detecting means can be used in common, number of component parts can be reduced. Also control of the first transport means, for example, can be carried out according to the output of such sheet feed detecting means.

The invention is characterized in that the oscillating piece detecting means derives a first signal only when the oscillating piece is angularly displaced by being pressed against a sheet, and otherwise derives a second signal, and by further comprising:

mode selecting means for selecting one mode from between duplex printing mode wherein toner images are formed and fixed on one side and the other side of a sheet, and simplex mode wherein a toner image is formed and fixed on, only one side of a sheet, and outputs a duplex mode signal when duplex printing mode is selected and outputting a simplex mode signal when the simplex printing mode is selected; and control means for responding to outputs of the mode selecting means and the oscillating piece detecting means and controlling the feeding means, the first and second transport means, the developing and image transfer means, and the fixing means, wherein in case the duplex mode signal is given, sheets are fed to the first transport path every predetermined first sheet feed period by the sheet feeding means, the sheet which has been transported to the first transport path is transported to the second transport path by the first transport means, while the sheet is being transported through the second transport path, a first toner image is formed on one side of the sheet by the developing and image transferring means and further fixed by the fixing means, then, when the output of the oscillating piece detecting means is switched from the second signal to the first signal, the first drive roller of the second transport means is driven to rotate in the first rotating direction to transport the sheet which has been guided into the discharge path in the discharging direction, after the lapse of a predetermined transport time since the output of the oscillating piece detecting means was switched from the first signal to the second signal, the rotating direction of the first drive roller is switched to the second rotation direction to transport the sheet to the third transport path, the sheet transported from the third transport path to the first transport path is transported again to the second transport path by the first transport means, while the sheet is being transported through the second transport path, a second toner image is formed on the other side of the sheet by the developing and image transferring means and further fixed by the fixing means, and when the output of the oscillating piece defecting means is switched from the second signal to the first signal, the first drive roller of the second transport means is driven to rotate in the first rotating direction to transport in the discharging direction the sheet guided into the discharging path by the third guiding means and thereby discharge the sheet to the outside, and in case the simplex mode signal is given, sheets are fed to the first transport every predetermined second sheet feeding period shorter than the first sheet feeding period by the sheet feeding means, the sheet fed to the first transport path is transported to the second transport path by the first transport means, while the sheet is being transported through the second transport path, a first toner image is formed on one side of the sheet by the developing and image transferring means and further fixed by the fixing means, and when the output of the oscillating piece detecting means is switched from the second signal to the first signal, the first drive roller of the second transport means is driven to rotate in the first rotating direction to transport in the discharging direction the sheet guided into the discharging path by the third guiding means and thereby discharge the sheet to the outside.

According to the invention, the duplex printing apparatus has the duplex printing mode and the simplex printing mode, as described above. In the simplex printing mode, a sheet is sent from the feeding means through the first transport path to the second transport path where an image is printed on only one side of the sheet, then the sheet passes the discharge path and discharged to the outside of the apparatus. In the duplex printing mode, an image is printed on one side of the sheet after similar process as in the simplex printing mode, then the sheet is reversed amid the discharge path to be transported to the first transport path again via the third transport path. An image is printed on the other side of the sheet in a process similar to that of the simplex printing mode, then the sheet is discharged through the discharge path. In this way, operations in the simplex printing mode and in the duplex printing mode are quite similar to each other. Because the third transport path is substantially parallel and near to the second transport path, time taken to return the sheet in the duplex printing mode is short. Consequently, time required for printing in the duplex printing mode is made shorter.

The invention is characterized in that:

the developing and image transferring means repeats the operation for forming a toner image on one side of a sheet plural times, and in case the simplex mode signal is given from the mode selecting means during printing of toner images on the sheet in the duplex printing mode, the control means controls the feeding means to feed the first sheet on which a toner image is to be printed in the simplex printing mode after the lapse of the first sheet feeding period since the last sheet whereon the toner image is to be printed in the duplex printing mode was fed into the first transport path, and thereafter feed sheets into the first transport path every second sheet feeding period.

In the duplex printing apparatus of the invention, when the mode is switched to the simplex printing mode during printing of a toner image in the duplex printing mode, the control means controls the sheet feeding timing of the feeding means and switches the transport method without stopping the printing operation. Thus because the mode can be switched without stopping the printing operation, printing efficiency can be improved. Also job efficiency of the apparatus can be improved by simply changing software specification.

The developing and image transferring means of the invention repeats the operation for forming a toner image on one side of sheets plural times, and in case the duplex mode signal is given from the mode selecting means during printing of the toner image on the sheet in the simplex printing mode, the control means controls the feeding means to feed the first sheet on which toner image is to be printed in the duplex printing mode when the second feeding time has elapsed after the last sheet whereon the toner image is to be printed in the simplex printing mode was fed into the first transport path, then to cause the sheets to be fed into the first transport path at intervals of the first feeding time.

In the duplex printing apparatus of the invention, when a command is issued to switch the mode to the duplex printing mode during printing of a toner image in the simplex printing mode, the control means controls the sheet feeding timing of the feeding means to switch the transport method without stopping the printing operation. Thus because the mode can be switched without stopping the printing operation, printing efficiency can be improved.

According to the invention, the duplex printing apparatus is capable of switching from the simplex printing mode to the duplex printing mode by merely controlling the timing of the operations of the feeding means and the transport means. Because the mode switching can be done by controlling only the operation timing, job efficiency of the apparatus can be improved by merely changing software specification.

The duplex printing apparatus of the invention further comprises print interrupting means for outputting a print interrupt signal to the control means for interrupting the printing of a toner image on a sheet, and is characterized in that, when the print interrupt signal is given from the print interrupting means, the control means responds to the print interrupting signal to stop the forming and fixing of the toner image in the developing and image transferring means and the fixing means and lets the first and the second transfer means transport sheets existing in the first through third transport paths toward the third direction, the first transport direction and the discharging direction, respectively, thereby to discharge the sheets from the discharging paths to the outside of the apparatus.

In the duplex printing apparatus of the invention, in case of a failure in the printing operation, print interrupt signal is issued to stop the printing of a toner image. In this print interrupting operation, sheets left in every path of the apparatus when the operation is stopped are automatically discharged. This makes it unnecessary for the user to remove sheets when printing is interrupted. Thus user's trouble can be eliminated by merely changing the software specification.

The duplex printing apparatus of the invention further comprises data supplying means for supplying image signals including image data of a toner image to be formed on one or the other side of a sheet, which are image data of toner images of the 1st through Nth pages (N is an integer not less than 3), to the developing and image transferring means, and causing the mode selecting means to output a duplex mode signal before printing of the toner image is started, and is characterized in that:

the control means controls the feeding means to transport the 1st through (N/2)th sheets successively into the first transport path and the developing and image transfer means to form the toner image of page 2n as the first toner image on one side of the nth (n=1, 2, . . . N/2) sheet and to form the toner image of page (2n−1) as the second toner image on the other side of the sheet.

In the duplex printing apparatus of the invention, when printing of a toner image is repeated plural times, toner images of even-numbered pages are printed on one side of the sheets and toner images of odd-numbered pages, the odd number being the even number minus 1, on the other side of the sheets. With this arrangement, printed sheets discharged from the apparatus are placed in the order of pages. Thus it is not necessary for the user to collate the sheets in the page order. Therefore, user's trouble can be eliminated.

BRIEF DESCRIPTION OF THE DRAWINGS

Other and further objects, features, and advantages of the invention will be more explicit from the following detailed description taken with reference to the drawings wherein:

FIG. 10A is a perspective view showing an upper oscillating member 124 having an energizing weight 134;

FIG. 10B is a perspective view showing the upper oscillating member 124 having a kick spring 135;

DETAILED DESCRIPTION OF THE PREFERRED EMBODIMENTS

Figure 1:
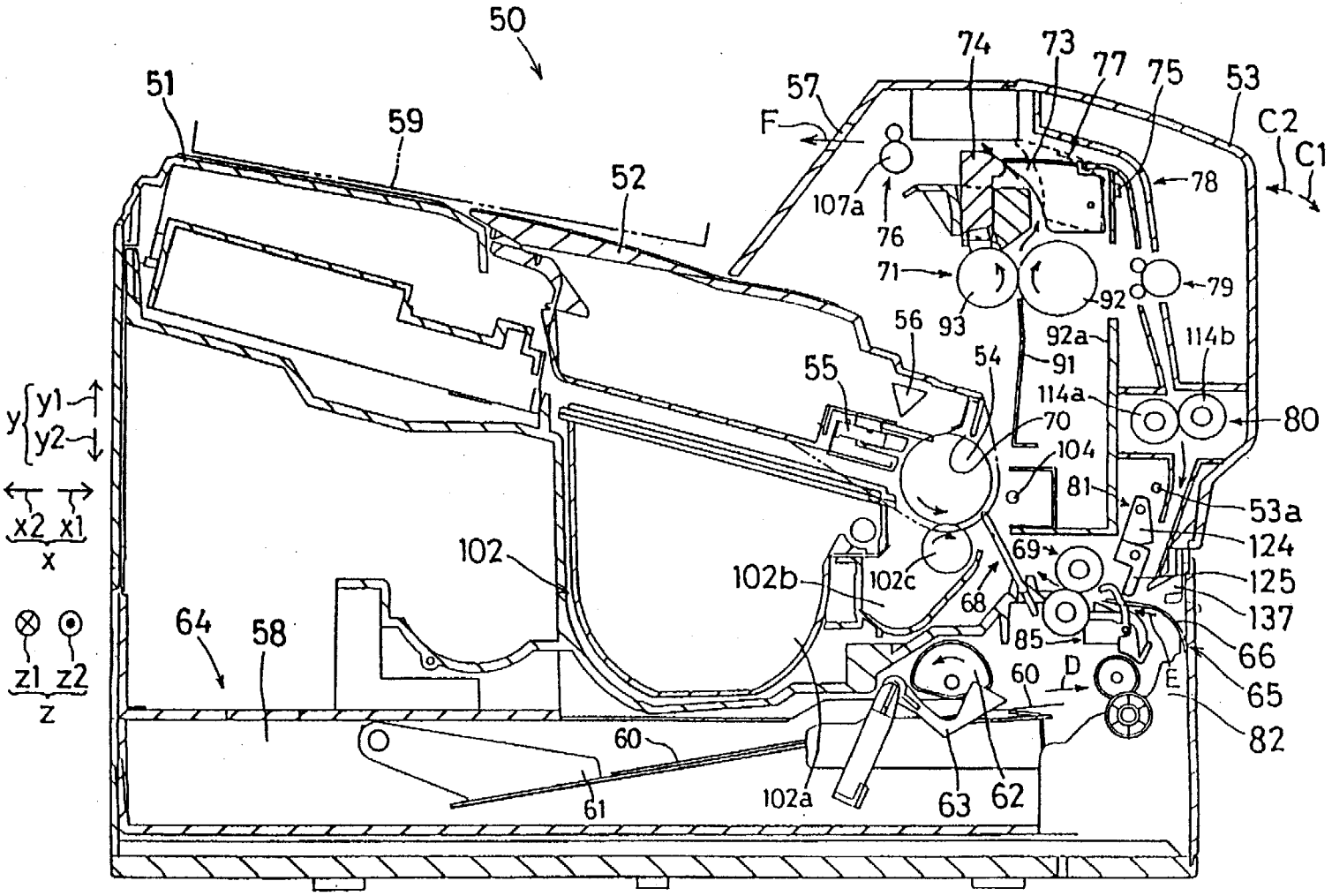
FIG. 1 is a sectional view showing a duplex printing apparatus 50 of a first embodiment of the invention.

Now referring to the drawings, preferred embodiments of the invention are described below.

Figure 2:
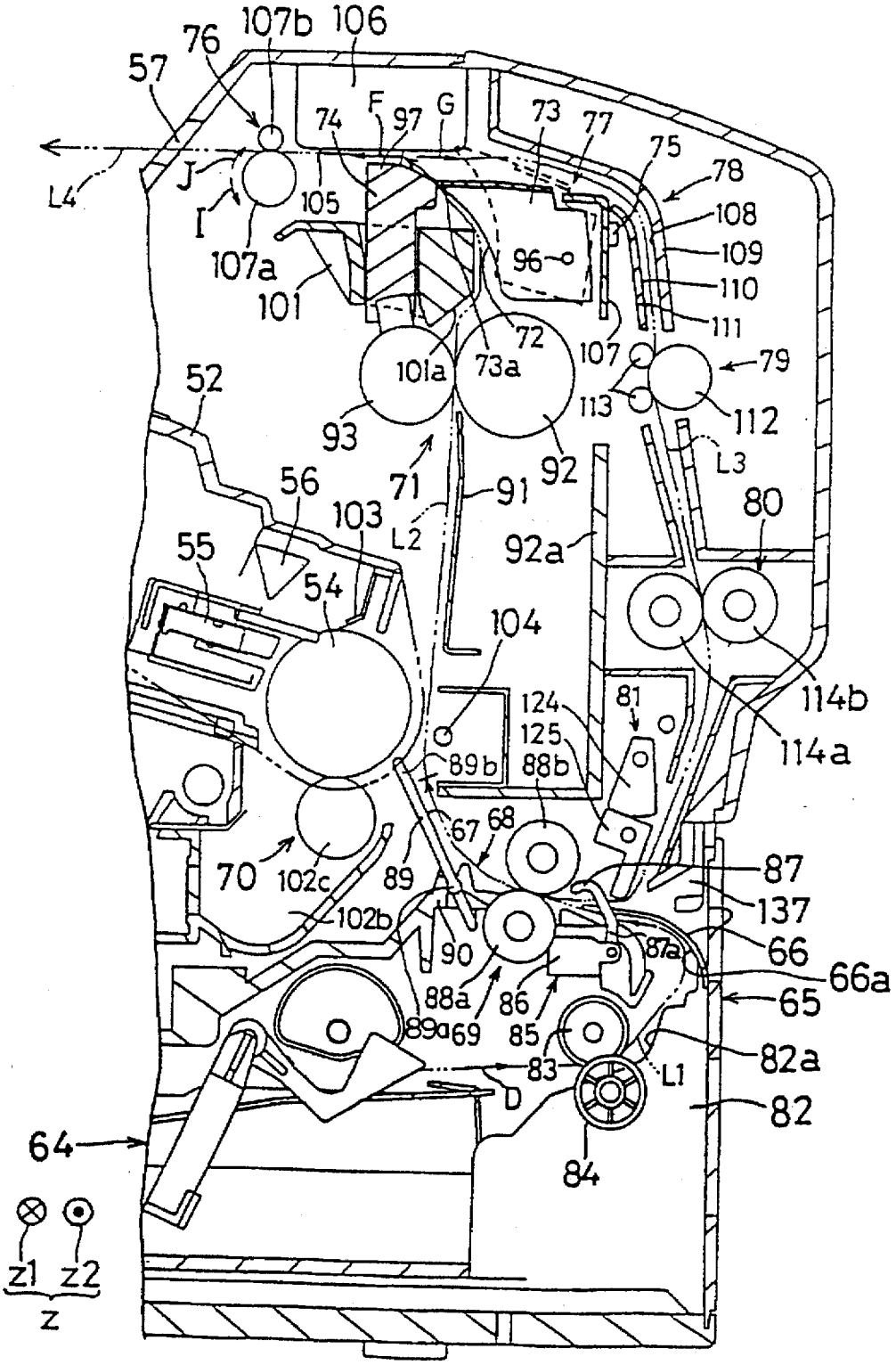
FIG. 2 is a sectional view showing one side of the duplex printing apparatus 50.

FIG. 1 is a sectional view showing a duplex printing apparatus 50 of a first embodiment of the invention. FIG. 2 is a sectional view showing the right side of the duplex printing apparatus 50. Description that follows will make reference to both FIG. 1 and FIG. 2. The duplex printing apparatus 50 prints images on at least one face or the other face of paper sheet 60. Hereinafter the face of the sheet 60 whereon an image is printed first will be referred to as front face and the face whereon an image is printed next will be referred to as back face. The duplex printing apparatus 50 is capable of printing images in either simplex printing mode or in duplex printing mode. In the simplex printing mode, images are printed on only the front face of the sheet 60. In the duplex printing mode, images are printed on the front face and the back face of the sheet 60.

Outline configuration of the duplex printing apparatus 50 will first be described below. The duplex printing apparatus 50 roughly comprises a printing apparatus body 51, a photosensitive unit 52 and a front door 53. The photosensitive unit 52 is installed in an upper portion of the duplex printing apparatus 51. The front door 53 is installed in the right-hand section of the duplex printing apparatus 50.

Hereafter, component elements located in the section indicated by the arrow y1 and the portion will be identified as "upper", and component elements located in the portion indicated by the arrow y2 and the portion will be identified as "lower". Component elements located in the portion indicated by the arrow x1 and the portion will be identified as "right", and component elements located in the portion indicated by the arrow x2 and the portion will be identified as "left" Further, component elements located on the upstream side in the feeding, transporting and discharging directions of sheets whereon images are to be printed and the corresponding portion will be identified as "one" and component elements and the portion on the downstream side will be identified as "the other".

The photosensitive unit 52 incorporates a cleaner unit 56 which includes a photosensitive drum 54, an electrostatic discharger 55 and a waste toner box. The photosensitive unit 52 is a dispensable kit and is installed detachably on the apparatus body 51. The front door 53 is installed to be free to make angular displacement around a pin 53*a* provided below the front door 53 as the center of rotation. Thus the front door 53 can open and close by making angular displacement in the direction of arrow C1 or arrow C2 with respective to the duplex printing apparatus 51. The front door 53 also incorporates fixing means 71.

Installed in the lower portion of the printing apparatus main body 51 is feeding means 64. The feeding means 64 is constituted from component elements including a sheet tray 58, a placing member 61, a feeding roller 62 and an energizing member 63. The sheets are stacked in plurality on the top surface of the placing member 61 located inside the sheet tray 58. One end of the placing member 61 located near the left side of the printing apparatus main body 51 is linked to a side face of the sheet tray 58 with a pin, so that the placing member 61 can freely make angular displacement in the direction of departing from the bottom surface or in the direction of approaching the bottom surface. Installed above the other end side of the placing member 61 is feeding rollers 62 having substantially semi-circular cross section and a plurality of rollers in the direction of the axis of rotation center. The other end of the placing member 61 is pressed in a direction of departing from the bottom surface of the tray 58, for example upward, by the energizing means 63. The energizing means 63 energizes the other end of the placing member 61 so that the sheet stack 60 and the feeding rollers 62 keep a predetermined distance.

When a start button provided on an upper chassis of the apparatus 50, for example, is pressed by an operator, printing of an image is initiated. At this time, the operator selects either simplex printing or duplex printing. When printing initiates, the feeding means 64 causes the feeding rollers 62 to rotate, When the rollers 62 make one revolution, one sheet 60 placed at the top-most position of the placing member 61 is transported in the feeding direction D toward the right side of the printing apparatus main body 51.

Installed in the right side portion of the duplex printing apparatus 50 is first guiding means 65. The guiding means 65 guides the sheet 60, which is sent from the feeding means 64 in the feeding direction D, into a first transport path L1 by inverting the sheet 60 into first transport direction E which is opposite to the feeding direction D. Second guiding means 68 is installed to cross the first transport path L1 on the downstream side in the first transport direction E. The second guiding means 68 guides the sheet 60, which is transported along the first transport path L1 in the first transport direction E, into the second transport L2 which is substantially parallel to the right side of the main body.

Installed between the first guiding means 66 of the first transport path L1 and the second guiding means 68 is first transporting means 69. The first transporting means 69 transports the sheet 60 to the second guiding means 68.

Installed above the second guiding means 68 is developing/image transferring means 70 with the second transport path L2 being interposed. The developing/image transferring means 70 forms a toner image on the front face or back face of the sheet 60. Installed further above the developing/image transferring means 70 is fixing means 71 with the second transport path L2 being interposed. The fixing means 71 fixes the toner image, which has been transferred on the sheet 60, onto the surface thereof. Through this process, a desired image is printed on the front face or back face of the sheet. Interposed above the fixing means 71 of the second transport path L2 is a cleaner 74.

Installed on the downstream side of the fixing means 71 in the second transport path L2 is third guiding means 77. The third guiding means 77 has an oscillating piece 73 which makes an angular displacement around an oscillation shaft 96, as will be described later. Angular displacement of the oscillating piece 73 is detected by detecting means 75 located above the fixing means 71. The third guiding means 77 guides the sheet 60 whereon an image is printed into a discharge path L4. The third guiding means 77 also guides sheet 60 from the discharge path L4 into the third guiding path L3 when printing on both sides.

Installed in the discharge path L4 on the downstream side of the cleaner 74 in the discharge direction F is second transporting means 76. When printing on at least one of the front face and the back face of the sheet 60 is completed, the sheet 60 is transported to the discharge path L4. The second transporting means 76 transports the sheet 60, which is guided along the discharge path L4 in the discharge direction F, further in the discharge direction F. When printed is completed and the sheet 60 is to be discharged, for example, the second transporting means 76 transports the sheet 60, from one edge on the upstream side in the discharge direction F of the sheet 60 to the other edge of on the downstream side, into the discharge path L4 on the downstream side of the second transport path L2. This causes the sheet 60 to be discharged by the second transporting means 76 through a discharge port 57 formed in the printing apparatus main body 51 on the downstream side in the discharge direction F.

When printing on only the front face of the sheet 60 is completed in case of printing in duplex printing mode, the sheet 60 discharged from the second path is first discharged toward the discharge direction F. Before the other edge of the sheet 60 reaches the second transporting means 76, rotating direction of the second transporting means 76 is reversed. This causes the sheet 60 to be transported in the refeeding direction G which is opposite to the discharging direction F of the third guiding means 77 and guided by the third guiding means 77 along the third transport path L3.

Installed on the downstream side of the third guiding means 77 in the refeeding direction G is a fourth guiding member 78. The fourth guiding member 78 guides the sheet 60, which is transported in the refeeding direction G, along the third transport path L3. The third transport path L3 is installed substantially in parallel with the second transport path L2 and nearer to the right side of the duplex printing apparatus 50 than the second transport path L2.

Installed at a position in the vicinity of the fixing means 71 of the third transport path L3 is correcting means 79. The correcting means 79 corrects nip of the sheet 60. Further installed below the correcting means 79 of the third transport path L3 is third transporting means 80 which transports the sheet 60. Installed below the third transporting means 80 is fifth guiding means 81. The fifth guiding means 81 guides the sheet 60, which is transported from the third transporting means 80, to incline along inclination of the first transport path L1 on the downstream side in the first transport direction as the sheet 60 approaches the first transport path L1. This causes the sheet 60 which has been transported through the retransport path L3 to be transported to the first transport path L1 on the upstream side of the first transporting means 69. At this time, the sheet 60 is sent to the first transport path L1 in such a state that the opposite side to that during transportation from the feeding means 64 faces upward.

Therefore, when printing in simplex printing mode, for example, the sheet 60 is transported from the feeding means 64 via the first transport path L1 to the developing/image transferring means 70 of the second transport path L2. When a toner image is transferred onto the sheet 60 by the means 70, the sheet 60 is further transported through the second transport path L2 while the image is fixed onto the sheet surface by the fixing means 71. The sheet 60 is transported from the second path to the discharge path L4 and is discharged from the discharge port 57 to the outside of the apparatus 50 by the second transporting means 76.

When an image is printed on the front face in the case of duplex printing, the sheet 60 is once transported from the second transport path L2 in the discharge direction F to reach the discharge path L4. The second transporting means 76 of the discharge path L4 transports the sheet 60 in the refeeding direction G before the sheet 60 is discharged from the discharge port 57. This causes the sheet 60 to pass from the discharge path L4 through the third transport path L3 and return to the first transport path L1. Because the sheet 60 is turned upside down at this time, when the sheet 60 is transported via the first transport path L1 to the second transport path L2, an image is printed on the back face of the sheet 60. The sheet with the image printed on the back face thereof is transported from the second transport path L2 to the discharge path L4, thereby to be discharged through the discharge port 57 to the outside of the apparatus 50.

Now the configuration described above and operations will be described in detail below.

The first guiding means 65 is constituted from a lower first guiding member 82 and a first guide plate 66 of a warped sheet shape. The lower first guiding member 82 has a lower guide surface **82*a* for guiding the sheet 60 upward. The first guide plate 66 has an upper guide surface 66*a* for guiding the sheet, which is guided by the lower guide surface 82*a***, in the first transport direction.

The lower first guiding member 82 is provided with first guide rollers 83, wherein a plurality of rollers are driven to rotate at predetermined intervals in the direction of rotation axis, being installed to face the lower first guide surface **82*a*. Second guide rollers 84 are installed to face the first guide roller 83 from below corresponding to the respective gaps between the rollers of the first guide rollers 83. The second guide rollers 84 have a plurality of rollers energized by, for example, springs. The sheet 60 fed from the feeding means 64 is first held between the first guide roller 83 and the second guide roller 84 and sent in the feeding direction D. When the sheet 60 reaches the first guiding means 65, the sheet 60 is guided by the first guiding means 65** to invert the transport direction and is further transported through the first transport path L1.

The first guide plate 66 is provided with sheet feed detecting means 85. The sheet feed detecting means 85 is provided with a sensor 86 and an actuation piece 87 linked with the sensor 86. The sensor 86 is installed at a lower portion of the first guide plate 66. The actuation piece 87 protrudes above the first guide surface 66 and a free end portion 87*a* thereof makes an angular displacement caused by the sheet 60 which is transported along the first transport path L1. For example, the sheet 60 guided by the first guiding means 65 presses the actuation piece 87 of the sheet feed detecting means 85 to make an angular displacement while being guided along the first guide plate 66. The sensor 86 is an optical sensor. The sensor turns on, for example, when a photoreceptor element and a light emitting element are intercepted in between by the actuation piece 87. Thus the sheet feed detecting means 85 detects feeding of the sheet 60. The sheet 60 which has pressed the actuation piece 87 is guided to the first transporting means 69.

The first transporting means 69 is installed near the downstream side of the sheet feed detecting means 85 in the first transport direction E. The first transporting means 69 comprises a first transport roller 88*a* and a driven roller 88*b*. The first transport roller 88*a* faces the first transport path L1 from below and drives to rotate. The driven roller 88*b* comes into contact with the first transport roller 88*a* from above the first transport path L1 and is driven by the first transport roller 88*a* to rotate.

The first transport roller 88*a* and the driven roller 88*b* each have a plurality of rollers installed at intervals on rotary shafts extending in the direction of rotation axis indicated by the symbol z. The direction of rotary shaft is a direction normal to an imaginary plane which includes the feeding direction D and the first transport direction E, while the imaginary plane is a plane parallel to the sheet surface in FIG. 1 and FIG. 2. Rollers of the first transport roller 88*a* are installed so that the circumferential surfaces thereof come into contact with the corresponding rollers of the driven roller 88*b*.

When the sensor 86 of the sheet feed detecting means 85 turns on, rotation of the first transport roller 88*a* is stopped momentarily. This causes the leading edge of the sheet 60 guided to the first transport means 69 to be adjusted. Then the sheet 60 is held between the first transport roller 88*a* and the driven roller 88*b* to be transported along the first transport path L1 to the second guiding means 68.

The second guiding means 68 has a second guide plate 89 having a second guide surface 67 and a support member 90, and is configured so that the second guide plate 89 is free to make angular displacement. A base portion 89*a* of the second guide plate 89 is installed near the first transporting means 69, and a free end portion 89*b* is installed facing the photosensitive drum 54. The support member 90 is installed on the base end portion 89*a* of the second guide plate 89 and supports an oscillation shaft which is perpendicular to the imaginary plane. The sheet 60 transported by the first transporting means 69 is guided to be transported in a direction along the second guide surface 67 of the second guiding means 68. Thus the sheet 60 is guided to the photosensitive drum 54.

The developing/image transferring means 70 has a photosensitive unit 52, an image transfer discharger 104 and a developing unit 102. Installed on one side of the photosensitive unit 52 near to the second transport path L2 are the photosensitive drum 54 having a straight cylindrical shape, a charger 55 and a cleaner unit 56. The charger 55 is installed near the circumference of the photosensitive drum 54 and forms an electrostatic latent image of the image to be printed on the surface of the photosensitive drum 54. Installed above the photosensitive unit 52 is a discharge tray 59 to receive the sheet 60 which is discharged from the discharge port 57, as shown in FIG. 1. The discharge tray 59 is indicated by an imaginary line in FIG. 1.

The developing unit 102 has a developer storage tank 102*a*, a stirring tank 102*b* and a developing roller 102*c*. Stored in the developer storage tank 102*a* is a toner agent which serves as the developer agent. In the stirring tank 102*b*, the toner agent supplied from the developer storage tank 102*a* is stirred. The developing roller 102*c* is installed in the stirring tank 102*b* and is disposed to keep a small clearance below the photosensitive drum 54 under the condition that the developer unit 102 is mounted in the printing apparatus 51. When an electrostatic latent image is formed on the photosensitive drum 54, spread of the toner agent attracted magnetically onto the circumference of the photosensitive drum 54 is rubbed against the circumference of the photosensitive drum 54. This causes the electrostatic latent image formed on the circumference of the photosensitive drum 54 by the electrostatic charger 55 to be developed.

The image transfer discharger 104 is disposed to oppose the photosensitive drum 54 interposing the second transport path L2. The toner image formed on the circumference of the photosensitive drum 54 is transferred from the circumference of the photosensitive drum 54 onto the sheet 60 by the image transfer discharger 104. The sheet 60 whereon the toner image is thus transferred is transported along the second transport path L2.

Installed in the second transport path L2 between the developing/image transferring means 70 and the fixing means 71 is a guiding member 91 of such a shape that conforms with the second transport path L2. The sheet 60 is transported along the surface of the guiding member 91 on the side of the third transport path L3. The guiding member 91 is tilted slightly toward the third transport path L3 upward. Therefore, the sheet supplied from the developing/image transferring means 70 is guided to the fixing means 71 without warping toward the photosensitive unit 52 and deviating significantly from the second transport path L2.

The fixing means 71 is installed above the guiding member 91 at a position nearer to the third transport path L3 with respect to the second transport path L2. The fixing means 71 comprises a pressure roller 92 and a thermal roller 93. The pressure roller 92 is mounted on a mounting frame 92*a* which is installed between the second transport path L2 and third transport path L3. The thermal roller 93 is installed on the opposite side of the pressure roller 92 with respect to the second transport path L2, and is heated to a predetermined temperature. The pressure roller 92 and the thermal roller 93 are cylindrical members having rotation axes parallel to the rotation axis direction indicated by the symbol z. The pressure roller 92 and the thermal roller 93 are in contact with each other on the circumferential surfaces thereof which are parallel to the axial line. The sheet 60 passes between the rollers 92, 93 so that the surface thereof where the toner image 93 has been transferred comes into contact with the thermal roller 93. In this process the toner image on the surface of the sheet 60 is fixed thereby printing the desired image. The sheet 60 whereon the image is printed is transported by the rollers 92, 93 to the third guiding means 77.

Figure 3:
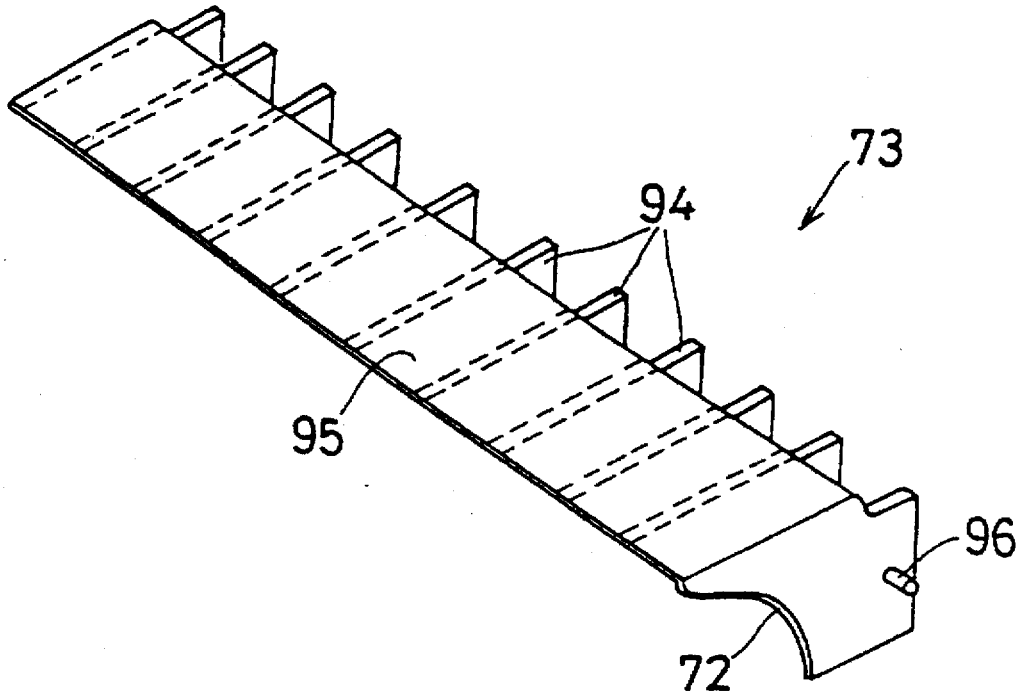
FIG. 3 is a perspective view showing an oscillating piece 73.

FIG. 3 is a perspective view showing the oscillating. piece 73 of the third guiding means 77. The oscillating piece 73 is provided with a plurality of ribs 94 of flat-plate shape parallel to the imaginary plane, arranged at intervals in parallel to the oscillation shaft 96 having a rotation axis which is parallel to the rotation axis direction indicated by the symbol z perpendicular to the imaginary plane. Each rib 96 of the oscillating piece 73 has a third guide surface 72 warped at a predetermined inclination angle. The sheet 60 transported along the second transport path L2 in the second transport direction is changed on the third guide surface 72 and is guided to the fourth transport path L4. Further installed above the ribs 94, namely at a position facing the sheet 60 being transported in the refeeding direction G, is a third guide plate 95 which is perpendicular to the imaginary plane, extending over the ribs 94.

Figure 4:
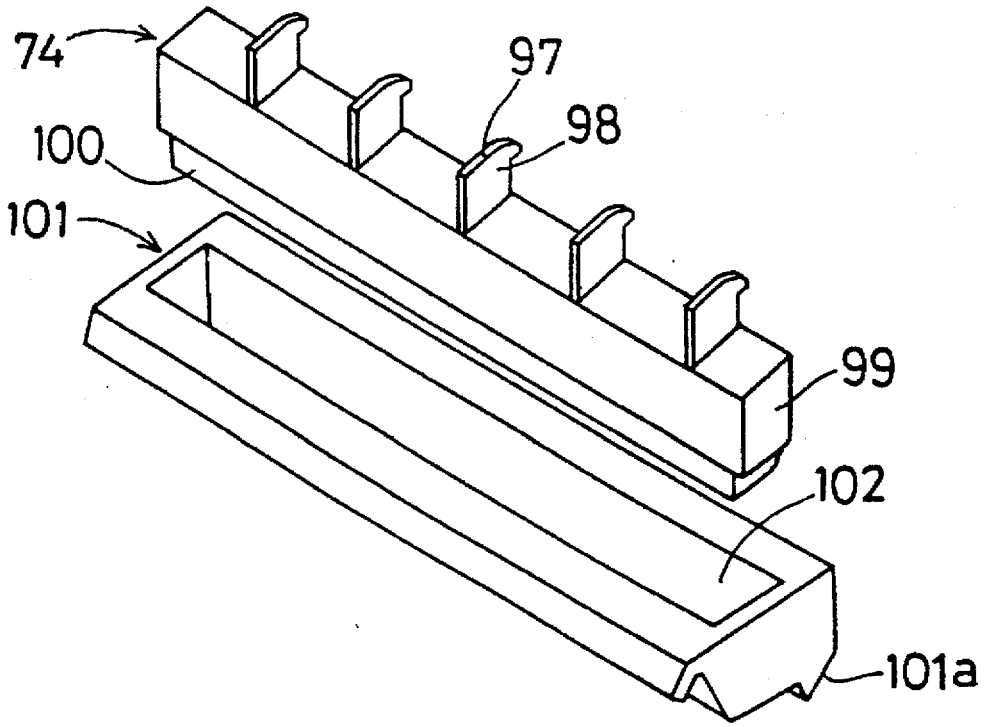
FIG. 4 is a perspective view showing a cleaner 74 and a cleaner holder 101.

FIG. 4 is a perspective view showing the cleaner 74 which is a support member of the third guiding member 77. The cleaner 74 comprises a plurality of ribs 98, a housing 99 and a felt 100. The cleaner 74 is provided with a plurality of ribs 98 of flat-plate shape parallel to the imaginary plane arranged at intervals in a direction perpendicular to the imaginary plane. Formed at the top of each rib 98 is a fourth guide surface 97 which is parallel to the discharge path L4. The surface of the fourth guide surface 97 on the side of the oscillating piece 73 is tilted more than the tilting angle of the third guide surface 72. The fourth guide surface 97 guides the sheet 60, which is guided along the third guide surface 72 of the oscillating piece 73, in the discharging direction F. The fourth guide surface 97 of the cleaner 74 comes into contact with the third guide plate 95 of the oscillating piece 73 from below. With this arrangement, the cleaner 74 supports the oscillating piece 73. Bottom surface of each rib 98 is fixed on the top surface of the housing 95 of substantially rectangular parallelepiped shape extending in the direction z perpendicular to the imaginary plane. The housing 99 is hollow inside opening downward so that a felt 100 is inserted through the aperture. One end of the felt 100 is disposed to protrude from the aperture of the housing 99.

The cleaner 74 is housed in a cleaner holder 101 freely detachably. The cleaner holder 101 is provided with a through hole 102 wherein the cleaner 74 is housed. The through hole 102 has a bottom aperture which opens under the cleaner holder 101. The cleaner holder 101 is mounted on the printing apparatus main body 51 in such an arrangement that the bottom aperture faces the thermal roller 93 of the fixing means 71. Therefore, the cleaner 74 is mounted on the apparatus so that the felt 100 comes into contact with the thermal roller 93. This arrangement makes it possible to wipe off the toner agent which sticks onto the surface of the thermal roller 93 as the thermal roller 93 rotates in the operation of fixing a toner image.

As shown in FIG. 2, a fifth guide surface 101*a* extending toward near the rotation axis of the thermal roller 93 is formed below the cleaner holder 101 on the oscillating piece 73 side. The sheet 60 is warped in the direction of being wound around the thermal roller 93 due to the heat of the thermal roller 93 when the sheet 60 is discharged from the fixing means 71. The warped sheet 60 is guided along the fifth guide surface 101*a* toward the third guide surface 72 of the oscillating piece 73.

Installed above the cleaner 74 is an upper guiding member 106 having an upper guide surface 105 which faces the cleaner 74 being formed below thereof. The upper guiding member 106 and the cleaner 74 define the discharge path L4.

Consequently, the sheet 60 discharged from the fixing means 71 is guided successively by the fifth guide surface 101*a* of the cleaner holder 101, then by the third guide surface 72 of the oscillating piece 73. While being transported along the third guide surface 72, the sheet 60 presses up the oscillating piece 73 by the rigidity thereof. This causes the oscillating piece 73 to make an angular displacement in such a direction that the oscillating piece 73 and the cleaner 74 depart from each other, generating a clearance therebetween. Then the sheet 60 passes through the clearance between the oscillating piece 73 and the cleaner 74 and is guided by the third guide surface 72, thereby to be transported to the discharge path L4.

Installed on the downstream side of the oscillating piece 73 in the refeeding direction G is a support member 107 having a cross section of inverted L shape as shown in FIG. 2. Installed on the third transport path L3 side of the support member 107 is a detector 75. The detector 75 is, for example, an optical sensor. When the oscillating piece 73 is pressed upward by the sheet 60, the sensor of the detector 107 turns on in response to the angular displacement of the oscillating piece 73 at the time. After the tail edge of the sheet 60 passes between the oscillating piece 73 and the cleaner 74, the oscillating piece 73 returns to the initial position by its weight and is supported by the cleaner 74. In response to the angular displacement at this time, the detector 75 turns off. Because the oscillating piece 73 returns to the initial position by its weight after the sheet has passed, the end portion 73*a* on the downstream side of the oscillating piece 73 in the discharging direction comes into contact with the right side end of the tilted surface of the fourth guide surface 97 of the cleaner 74. This blocks the path from the discharging path L4 to the second transport path L2 except for when the sheet 60 is transported from the second transport path L2 to the discharge ink path L4. Therefore, when the sheet 60 is refed from the discharging path L4, the sheet 60 is prevented from being transported again to the second transport path L2.

The second transport means 76 comprises a first drive roller 107*a* which is installed below the discharge path L4 and a driven roller 107*b* which is installed above the discharge path L4. The driven roller 107*b* is a roller having a diameter smaller than that of the first drive roller 107*a*. The first drive roller 107*a* and the driven roller 107*b* each comprise a plurality of rollers arranged at intervals in the direction of rotation axis indicated by the symbol z. Each roller of the first drive roller 107*a* is in contact with each roller of the corresponding driven roller 107*b*. The first drive roller 107*a* selectively rotates either in the first rotating direction I which corresponds to the discharging direction F or in the second rotating direction J opposite to the first rotating direction.

The sheet 60 transported between the oscillating piece 73 and the cleaner 74 to the discharging path L4 is transported by the second transporting means 76 in the discharging direction F and in the refeeding direction G. When the sensor of the detector 75 turns on, for example, the first drive roller 107*a* is driven to rotate in the first rotating direction I. This causes the sheet 60, which is fed through the clearance to the second transporting means 76 in the discharging direction F, to be held between the first drive roller 107*a* and the driven roller 107*b* from one end on the downstream side in the transport direction F, and further transported in the discharging direction F. The sheet 60 is transported to the outside of the discharge port 57 gradually from one end on the downstream side in the discharge direction F.

During simplex printing, the first drive roller 107*a* is driven to rotate only in the first rotating direction I. Therefore, the sheet 60 is transported so that the whole sheet from one edge to the other edge moves over the discharge port 57. Thus the sheet 60 is discharged into the discharge tray.

In case duplex printing is specified by the operator and an image has been printed only on the front face of the sheet, the first drive roller 107*a* reverses the rotating direction amid discharging of the sheet 60. When the other edge of the sheet 60 has passed the clearance between the oscillating piece 73 and the cleaner 74, for example, the sensor of the detector 75 turns off. A timer counts the elapse of time since the sensor turned off. Upon elapse of a predetermined period, the first drive roller 107*a* is reversed to the second rotating direction J. The predetermined period has the same length as the time taken by the other edge of the sheet 60 to reach the fourth guide surface 97 of the cleaner 74 since the other edge of the sheet 60 passed the clearance.

At this time, when one edge of the sheet 60 is discharged toward the discharge tray 59 which is installed below the discharge port 57, the other edge is directed upward. Consequently, when rotating direction of the roller 107*a* is reversed, the sheet 60 is guided along the top guide surface 105 in the refeeding direction G. This causes the sheet 60 to be transported over the upper guide plate 95 of the oscillating piece 73 and reach the third transport path L3. The sheet 60 transported through the third transport path L3 is sent to the fourth guiding member 78. The portion of the third transport path L3 near the discharge path L4 is substantially parallel to the direction indicated by the arrow x, and the portion beyond the fourth guiding member 78 is substantially parallel to the second transport path L2.

The fourth guiding member 78 comprises an outer guiding member 109 and the inner guiding member 111. The outer guiding member 109 has an outer guide surface 108 which warps the sheet 60, which is transported through the third transport path L3 in the refeeding direction G, thereby bending the transport direction. The inner guiding member 111 has an inner guide surface 110 which opposes the outer guiding member 108. Therefore, the sheet 60 supplied to the fourth guiding member 78 is transported along the outer guide surface 108 so that the transport direction is bent 90 degrees and the sheet 60 is guided into the third transport path L3 following the fourth guiding member. The sheet 60 of which transport direction has been bent is sent to the correcting means 79.

The correcting means 79 comprises a second drive roller 112 and a pair of first correcting rollers 113*a*, 113*b* which are in contact with the second drive roller 112. The second drive roller 112 is installed at a position near the fixing means 71, the position being near to the right side of the duplex printing apparatus 50 with respect to the third transport path L3. The first correcting rollers 113*a*, 113*b* are installed near the pressure roller 92 of the fixing means 71 with respect to the third transport path L3. In this embodiment, for example, the first correcting rollers 113*a*, 113*b* are installed where the distance from the pressure roller 92 is within 20 mm.

The mounting frame 92*a* is provided with an aperture between the fixing means 71 and the correcting means 79, so that heat is transmitted from the fixing means 71 to the correcting means 79. The second drive roller 112 and either one of the first correcting rollers 113*a*, 113*b* are made of aluminum which has a high thermal conductivity. The other one of the rollers 113*a*, 113*b* is made of a heat-resistant rubber, for example, silicone rubber. These rollers 112; 113*a*, 113*b* are axially supported at positions outside both ends of the fixing means 71 in the direction of the rotation axis indicated by the symbol z.

Figure 5:
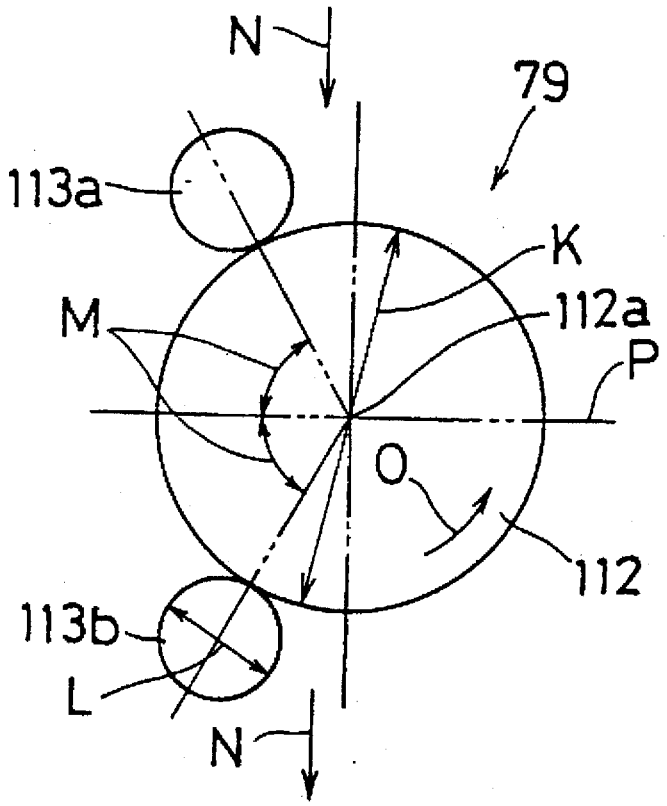
FIG. 5 is an illustrative view explaining the configuration of a correcting means 79.

FIG. 5 is an enlarged schematic drawing showing the correcting means 79. The first correcting rollers 113*a*, 113*b* have rotary shafts at positions where the shafts are at the same angle M from a plane P at right angles with the third transport direction N, and pass the rotation axis 112*a* of the second drive roller 112. Relationship between the diameter K of the second drive roller 112, the diameter L of the correcting rollers 113*a*, 113*b* and the angle M can be expressed as follow.

$$L \leqq K/2 \quad (1)$$

$$K/3 \leqq L \leqq K/2 \quad (2)$$

When the inequality (1) is satisfied, the angle M is preferably within 45 degrees. When the inequality (2) is satisfied, the angle M is preferably within 60 degrees. When diameter L of the correcting rollers 113 is less than K/3, rotation torque of the second drive roller 112 increases and causes an influence on the transportation of the sheet 60. Therefore, diameter L of the correcting rollers 113*a*, 113*b* is preferably K/3 or greater.

The sheet 60 whereon the toner image is fixed by the fixing means 71 is transported in such a condition as curled in the direction of being wound around the thermal roller 93 by heat. When the sheet 60 under this condition is supplied to the correcting means 79, the sheet 60 is pressed by the correcting rollers 113*a*, 113*b* against the circumferential surface of the first drive roller 112 so that the sheet is warped in the opposite direction to the curl while receiving heat from the fixing means 71, and is sent. Thus the curl made by the fixing means 71 is surely corrected by the correcting means 79. The sheet 60 of which curl is corrected is sent to the third transporting means 80.

The third transporting means 80 has a third drive roller 114*a* and a driven roller 114*b*. The third drive roller 114*a* is installed near to the second transport path L2 with respect to the third transport path L3, and is driven to rotate by a rotation drive source 115 to be described later. The driven roller 114*b* is installed on the opposite side of the third transport path L3 from the third drive roller 114*a*.

Figure 6:
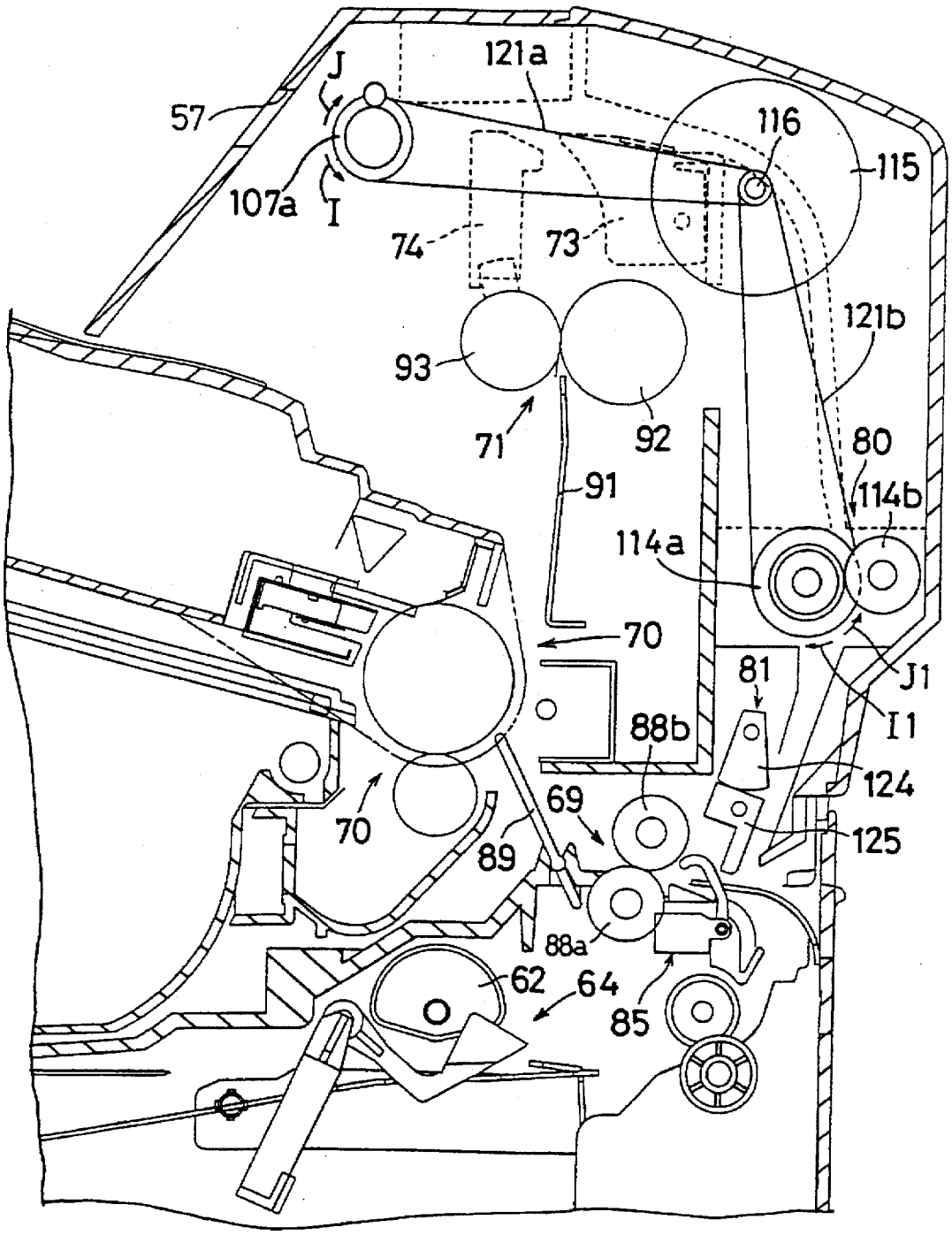
FIG. 6 is a sectional view showing the relationship between a third drive roller 114*a*, a first drive roller 107*a* and a rotation drive source 115.

FIG. 6 is a sectional view showing the relation between the third drive roller 114*a*, first drive roller 107*a* and the rotation drive source 115. The rotation drive source 115 is realized by a motor having a rotary shaft 116 which is free to rotate, for example. The rotation drive source 115 is installed in an upper portion of the duplex printing apparatus 50 at a position near to the right side thereof. The rotary shaft 116 of the rotation drive source 115 is linked to the first drive roller 107*a* and the third drive roller 114*a* via belts 121*a*, 121*b*, respectively. Torque of the rotation drive source 115 is transmitted to the first and the third drive rollers 107*a*, 114*a* via belts 121*a*, 121*b*, respectively.

Figure 7:
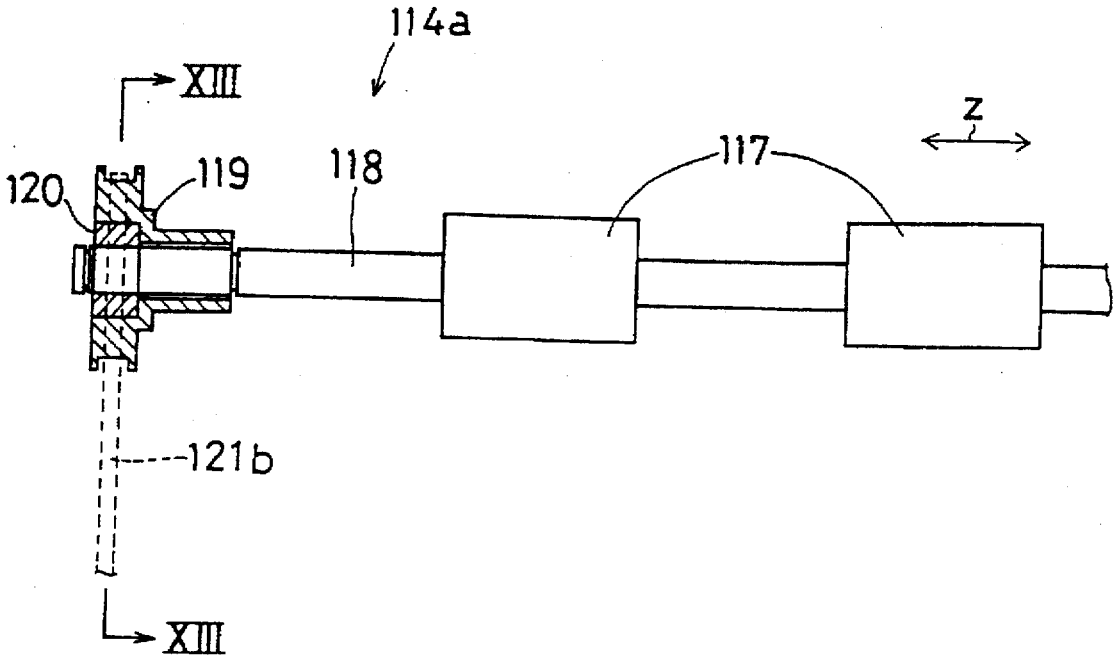
FIG. 7 is a sectional view showing a third drive roller 114*a;*
Figure 8:
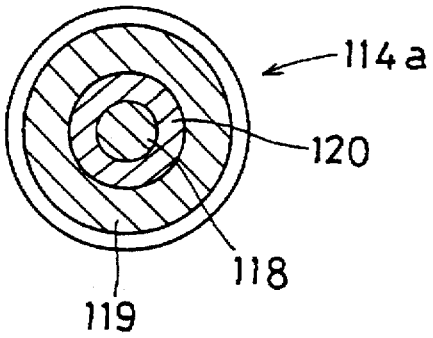
FIG. 8 is a sectional view taken along line VIII—VIII in FIG. 7.

FIG. 7 is a sectional view showing the third drive roller 114*a*. FIG. 8 is a sectional view taken on the cutting-plane line XIII—XIII of FIG. 7. The third drive roller 114*a* is constituted by arranging a plurality of cylindrical rollers 117 at intervals on the rotary shaft 118 in the rotation axis direction z thereof. Each roller of the driven roller 114*b* comes into contact with each corresponding roller 117 of the third drive roller 114*a*. Installed at either one end of the rotary shaft 118 of the third drive roller 114*a* in the rotation axis direction is a pulley 119. Pressure-inserted to the pulley 119 is a clutch 120. The belt 121*b* is wound around the rotary shaft 116 of the rotation drive source 115 and the pulley 119 of the third drive roller 114*a*.

The clutch 120 has a mechanism which transmits, of the rotation torque transmitted to the pulley 119, only the rotation torque in the predetermined direction to the rotary shaft 118 and does not transmit rotation torque in the direction opposite to the predetermined direction. In this embodiment of the invention, the clutch 120 transmits only the rotation torque in the third rotating direction I1 wherein the third drive roller 114*a* transports the sheet 60 to the fifth guiding means 81.

Consequently, when the pulley 119 of the third drive roller 114*a* is driven by the rotation drive source 115 to rotate in the rotating direction I1, the rotation torque is transmitted to the rotary shaft 118 via the clutch 120. At this time, the sheet 60 is further transported by the third transporting means 80 further on the third transport path L3 and is guided by the fifth guiding means 81 to enter the first transport path L1 again. As described previously, the sheet 60 is transported to the third guiding means 77 similarly to the case of printing on the front face, after having an image printed on the back face of the sheet 60 by the developing/image transferring means 70 and the fixing means 71. One edge of the sheet 60 which is transported by the third guiding means 77 presses up the oscillating piece 73 again. This causes the detecting means 75 to turn on.

Since the sheet 60 was transported by the third transporting means 80, the rotary shaft 116 of the rotation drive source 115 has been continuing to rotate in the direction of driving the third drive roller 114*a* to rotate in the third rotating direction I1. Throughout this period, the first drive roller 107*a* which is linked with the rotary shaft 116 of the rotation drive source 115 via the belt 121*a* is rotating in the rotating direction J.

When the detecting means 75 turns on, as described previously, the rotation drive source 115 reverses the first drive roller 107*a* to the first rotating direction I in order to discharge the sheet 50 from the second transporting means 76. This causes the sheets 60 transported on the discharge path L4 to be successively discharged by the second transporting means 76 from one end thereof to the outside of the discharge port 57.

When the length of the sheet 60 in the transporting direction is longer than the length of the path from the third transport path L3 to the terminating end of the second transport path L2, the other edge of the sheet 60 is still engaged by the third transporting means 80 at the time the detecting means 75 is turned on. In case the detecting means 75 is switched to on at this time, the pulley 119 rotates in the forth direction J1 which is opposite to the third rotating direction I1. Because the pulley 119 is provided with the clutch 120, rotation torque in this rotating direction J1 is not transmitted to the rotary shaft 118. At this time, the third drive roller 114*a* rotates in the third rotating direction I1 due to the movement of the discharged sheet 60.

This makes it possible to transport and discharge the sheet 60 smoothly even when the length of the sheet 60 is long. In this embodiment, the rotation drive source 115 transmits rotation torque to the first drive roller 107*a* and the third drive roller 114*a* via the belts 121*a*, 121*b*, respectively. This transmission of rotation torque may also be done by means of rotating gears.

Figure 9:
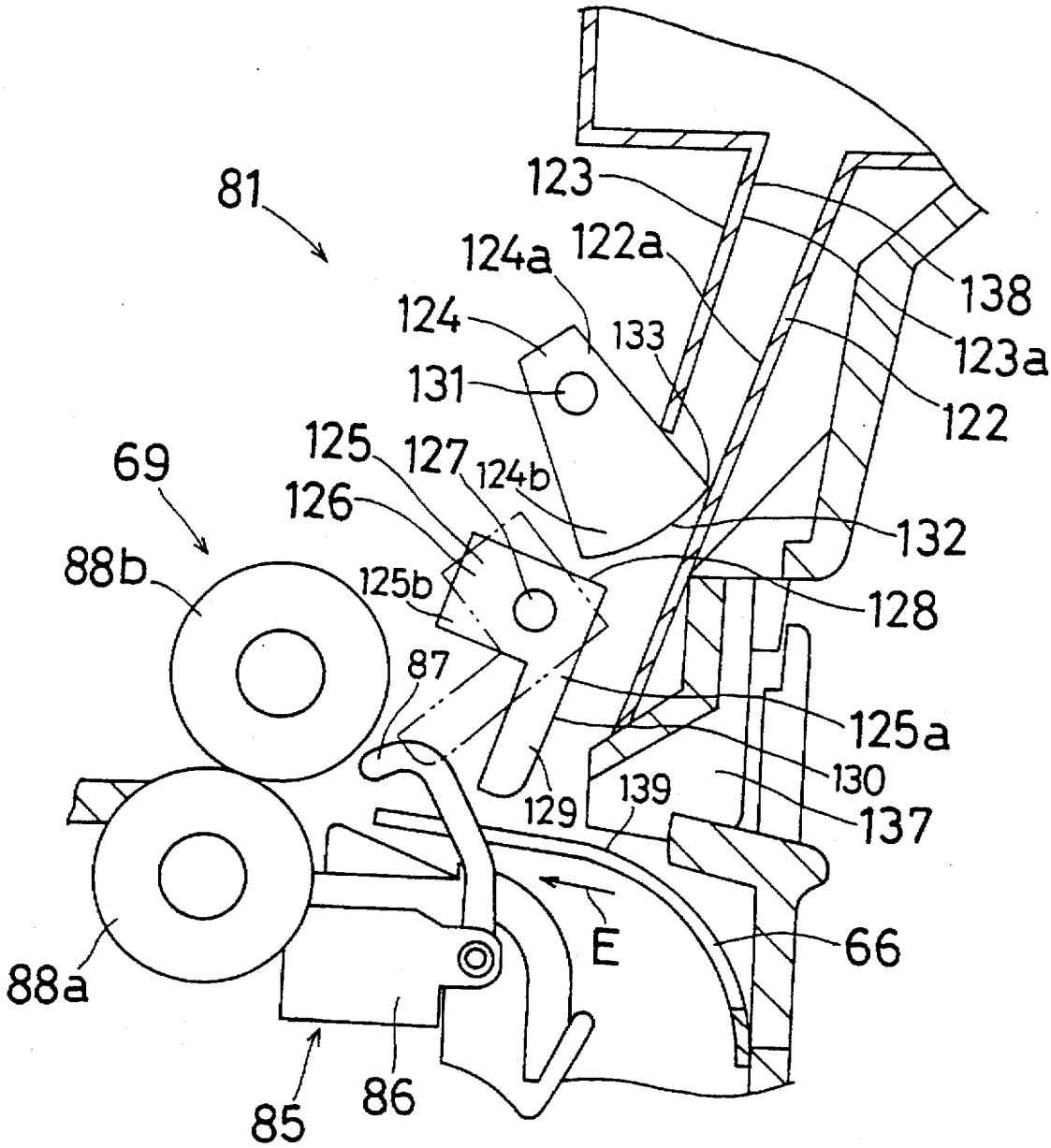
FIG. 9 is an enlarged sectional view of a portion in the vicinity of fifth guiding means 81.

FIG. 9 is an enlarged sectional view showing the vicinity of the fifth guiding means 81. The fifth guiding means 81 has an outer guiding member 122, an inner guiding member 123, an upper oscillating member 124 and a lower oscillating member 125. The outer guiding member 122 is installed near the right side of the duplex printing apparatus 50. The outer guiding means 122 has an outer guide surface 122*a* installed to tilt toward the downstream side in the first transporting direction E toward the first guide plate 66. The outer guide surface 122*a* guides the sheet 60 transported from the third transporting means 80 toward the first transport path L1. The inner guiding member 123 is installed substantially in parallel to the outer guiding member 122. Further, the inner guiding member 123 has an inner guide surface 123*a* which extends to near the upper oscillating member 124 and faces the outer guide surface 123*a*.

FIG. 10 is a perspective view showing the upper oscillating member 124. Reference will be made to both FIG. 9 and FIG. 10. The upper oscillating member 124 has a plurality of ribs 124*a* installed on the oscillation shaft 131. The ribs 124*a* are installed in parallel with and having a space separating each other on the oscillation shaft 131 which is pivoted at the base thereof. The plurality of ribs 124*a* are free to make angular displacement with respect to the oscillation shaft 131. Formed on the free ends 124*b* of the ribs 124*a*, located below the oscillation shaft 131, are arc-shaped support surfaces 132 facing the lower oscillating member 125.

The free end portions 124*b* of the ribs 124*a* of the upper oscillating member 124 are energized by energizing means toward the outer guide surface 122*a* of the outer guiding member 122. One end portion 133 near the outer guide surface 122*a* on the free end portion 124*b* side of the rib 124*a* of the upper oscillating member 124 is in contact with the outer guide surface 122*a*.

Figure 11:
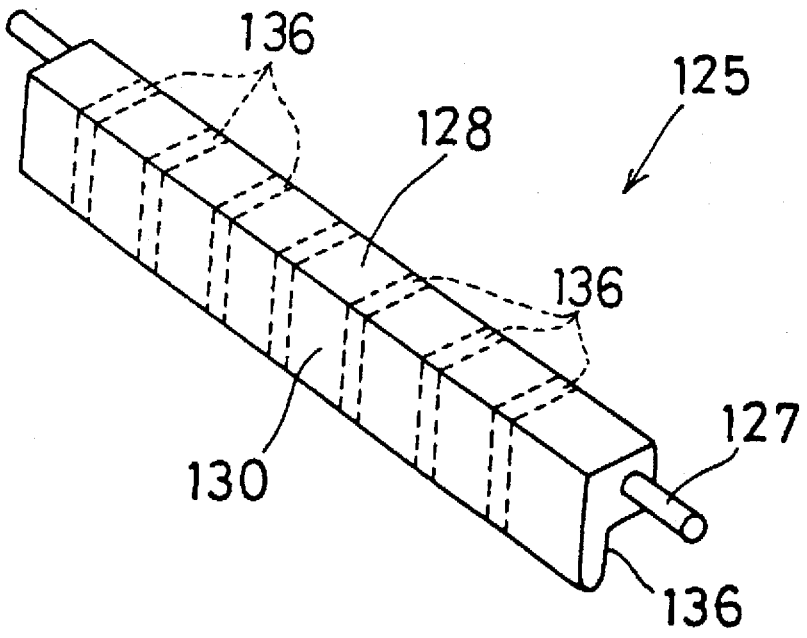
FIG. 11 is a perspective view showing a lower oscillating member 125.

The energizing means is realized, for example, by an energizing weight 134 as shown in FIG. 10(*a*). The energizing weight 134 is fixed on the oscillation shaft 131 under the condition that one end portion 133 of each rib 124*a* of the upper oscillating member 124 is in contact with the outer guide surface 122*a* of the outer guiding member 122. The energizing weight 134 tilts leftward by a predetermined angle θ from an imaginary axis y of the vertical direction wherein the gravity acts. The energizing weight 134 is provided with a free end portion installed at a position of departing from the vertical imaginary axis y to the downstream side in the first transporting direction E. Each rib 124*a* is energized by the rotation moment of the energizing weight 134 against the outer guide surface 122*a*. The energizing means may alternatively realized by employing a kick spring 135 and energizing the ribs 124*a* with the energizing force of the spring as shown in FIG. 10(*b*). FIG. 11 is a perspective view showing the lower oscillating member 125. Reference will be made to both FIG. 11 and FIG. 9 in the description that follows. The lower oscillating member 125 has a plurality of ribs 136 installed in parallel with and having a space separating each other. Base portions of the ribs 136 are pivoted on the oscillation shaft 127 so that the ribs are free to make angular displacement around the oscillation shaft 127.

Formed on the base portions of the ribs 136 of the member 125 are first projection 126 and a second projection 129. The first projection 126 is formed to protrude from the base portion of the member 125 in a direction of departing from the outer guiding member 123 with respect to the oscillation shaft 127. Installed at upper ends of the first projection 126 and the base facing the upstream side of the transporting direction is a flat plate in a direction perpendicular to the ribs 136. Thus a flat contact plane 128 facing the upper oscillating member 124 is formed at the upper end of the first projection.

The second projection 129 is formed on a side portion 125*a* which faces the outer guiding member 122 at the base of the lower oscillating member 125. The second projection 129 is a suspended portion protruding toward an upper guide surface 139 of the first guide plate 66 of the first guiding member 65. The ribs 136 are provided with a flat plate in the direction perpendicular to the ribs 136 at the base and the right end facing the outer guiding surface 122*a* of the second projection 129. Thus a guide surface 130 facing the outer guiding member 122 is formed on the base portion and the second projection 129. The guide surface 130 is perpendicular to the contact surface 128. Corner of the second projection 129 of the guide surface 130 on the free end side is formed in a round shape. This makes it possible to guide the sheet transported by the third transporting means 80 smoothly.

Now reference will be made again to FIG. 9. In the path L3 on the downstream side of the free end portion of the second projection 129 of the lower oscillating member 125 in the first transport direction E, the actuation piece 87 of the sheet feed detecting means 85 described previously protrudes beyond the first guide plate 66. Further installed on the downstream side in the direction E is the first transporting means 69. The third transport path L3 slopes down from the third transporting means 80 along the outer guide surface 122*a* of the outer guiding member 122. The path L3 bends to a direction substantially parallel to the first transport direction E between the lower oscillating member 125 and the first guide plate 66 of the first guiding member 65. Therefore, the path L3 passes further below the free end portion on the downstream side in the transport direction of the second projection 129 of the lower oscillating member 125, and joins the first transport path L1 immediately before the first transporting means 69.

Formed on the right side of the printing apparatus main body 51 is a manual feed port 137 opening toward the outside of the apparatus. The manual feed port 137 is located at an upper position than the first guide plate 66 of the first guiding member 65, and faces the last end portion of the third transport path L3. The sheet 60 fed from the manual feed port 137 is guided by the upper guide surface 139 above the first guide plate 66 from the feed port 137 to pass below the free end portion of the lower oscillating member 125 and joins the first transport path L1 on the upstream side of the first transporting means 69.

As described previously, the upper oscillating member 124 is energized to come into contact with the outer guide surface 122*a*. This causes the contact surface 128 of the lower oscillating member 125 and the support surface 132 of the upper oscillating member 124 to depart from each other. Consequently, the lower oscillating member 125 can freely make angular displacement without obstruction from the lower oscillating member 124. Therefore, when the sheet 60 is fed manually from the manual feed port 137, the sheet 60 can be smoothly fed.

The sheet 60 transported by the third transporting means 80 to the fifth guiding means 81 is guided along the path L3 which is defined by the outer guide surface 122*a* and the inner guide surface 123*a*. When the sheet 60 comes into contact with the upper oscillating member 124, the sheet 60 causes the free end portion of the upper oscillating member 124, which is energized so that the support surface 132 touches the outer guide surface 122*a*, to make angular displacement toward the lower oscillating member 125. Then the portion of the support surface 132 of the upper oscillating member 124 which is near the lower oscillating member 125 comes into contact with the contact surface 128 located near the other end 125*b* with respect to the oscillation shaft of the lower oscillating member 125. This prevents the free end portion of the second projection 129 of the lower oscillating member 125 from making angular displacement toward the downstream side in the first transport direction E. Thus the sheet 60 transported from the third transporting means 80 is guided by the guide surface 130 of the second projection 129 of the lower oscillating member 125.

The sheet 60 guided by the guiding surface 130 is guided by the upper guide surface 139 of the first guide plate 66 via the free end portion of the second projection 129. This causes the sheet 60 to reliably press down the actuation piece 87 of the sheet feed detecting means 85. Therefore, when the sheet 60 passes the upper guide surface 139, the sensor 86 certainly turns on. The sheet 60 is further fed to the first transporting means 69. When the sensor 86 turns on, rotation of the first transport roller 88*a* momentarily stops. This makes one edge of the sheet 60 transported in the first transport direction E aligned by the first transporting means 69. When the other edge of the sheet 60 to be printed on the back face thereof passes the sheet feed detecting means 85, the sensor 86 turns off thereby detecting the passage.

Figure 12:
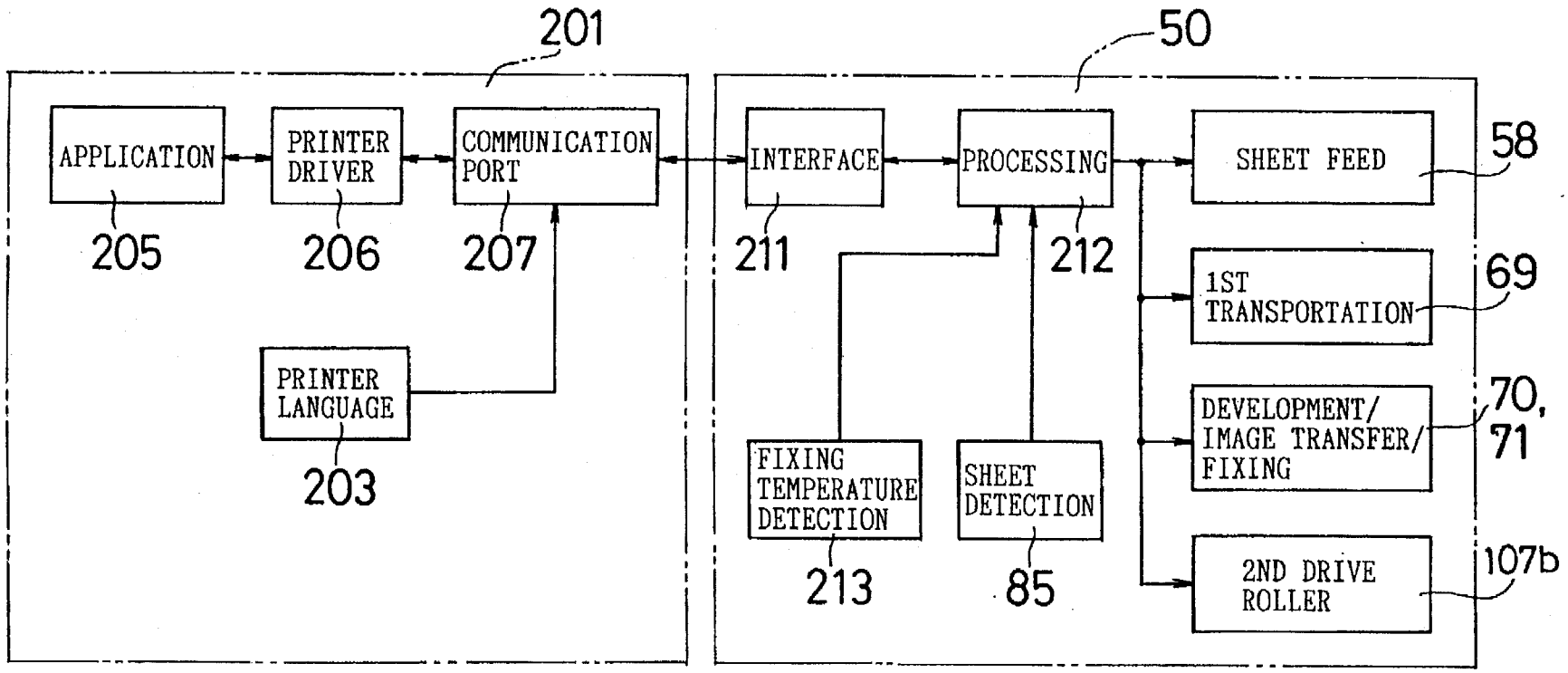
FIG. 12 is a block diagram showing the electrical configuration for explaining the control method of the duplex printing apparatus of FIG. 1.

When the passage is detected, the feeding means 64 feeds a new sheet 60. Distance between the other edge of the sheet 60 to be printed on the back face thereof and one edge of the newly fed sheet 60 is preferably set to be short. The sheet 60 transported by the first transporting means 69 is guided by the second guiding means 68 to the developing/image transferring means 70. After a toner image is transferred onto the back face of the sheet 60 by the developing/image transferring means 70, the toner image fixed by the fixing means 71. Thus the image is printed on the back face of the sheet. When images are printed on both sides of the sheet 60, the sheet 60 is transported by the second transporting means 76 via the third guiding means 77. The second transporting means 76 discharges the sheet through the discharge port 57 onto the discharge tray FIG. 12 is a block diagram showing the electrical configuration for the explanation of the control of the duplex printing apparatus 50 of FIG. 1. Image data of a toner image to be printed on the sheet surface by the developing/image transferring means 70 and the fixing means 71 of the duplex printing apparatus is generated in a host apparatus 201 which is connected to the duplex printing apparatus 50, and is supplied to the duplex printing apparatus 50. Component elements of both the host apparatus 201 and the duplex printing apparatus 50 will be described below.

Image data is generated in the host apparatus 201 by means of two techniques. With the first technique, the operator operates a printer language apparatus 203 to generate image data which represents a toner image. The image data consists of signals conforming with a signal protocol which can be directly processed in the apparatus 50. In the second technique, the operator generates basic data which represents the toner image by operating an application apparatus 205. The basic data consists of signals conforming with a signal protocol which cannot be processed in the apparatus 50. The basic data generated in the application apparatus 205 is converted by a printer driver 206 to data conforming with the signal protocol which can be processed in the apparatus 50. Image data is thus generated. The image data generated in either of the above techniques is given to the apparatus 50 via a communication port 207.

The image data supplied as described above corresponds to, for example, a single toner image. Such a situation can be conceived that a text extending a plurality of pages is generated in the application apparatus 205 which is, for example, a word processor, and the text is printed on the duplex printing apparatus 50. In this case, the text data which represents the text is divided in the printer driver 206 into data sets each representing the text block of the corresponding page, and is then converted to image data of each data set. Thus image data sets for a plurality of pages are generated from the data of a single text. These image data sets are printed on either one face or the other face of the sheet.

In the duplex printing apparatus 50, the image data is supplied via the interface 211 to the processing circuit 212. The processing circuit 212 carries out processing operations to be described later based on the image data given, and prints the toner image represented by the image data on the sheet surface by using the developing/image transferring means 70 and the fixing means 71. In relation to the fixing means 71, a fixing temperature detecting means 213 is installed. The fixing temperature detecting means 213 detects the fixing temperature at which the sheet and the toner image are heated by the thermal roller of the fixing marts. The processing circuit 212 controls the temperature of the thermal roller to keep the fixing temperature at a predetermined desired value.

Given to the processing circuit 212 are a sheet passage detection signal from the sheet detecting means 85 and an angular displacement detection signal from the oscillating piece detecting means. According to these signals, the processing circuit 212 controls the operations of the feeding means 58, the first transporting means 69 and the second drive roller 107*b*, thereby adjusting the sheet feeding and transporting operations, as will be described later.

Figure 13:
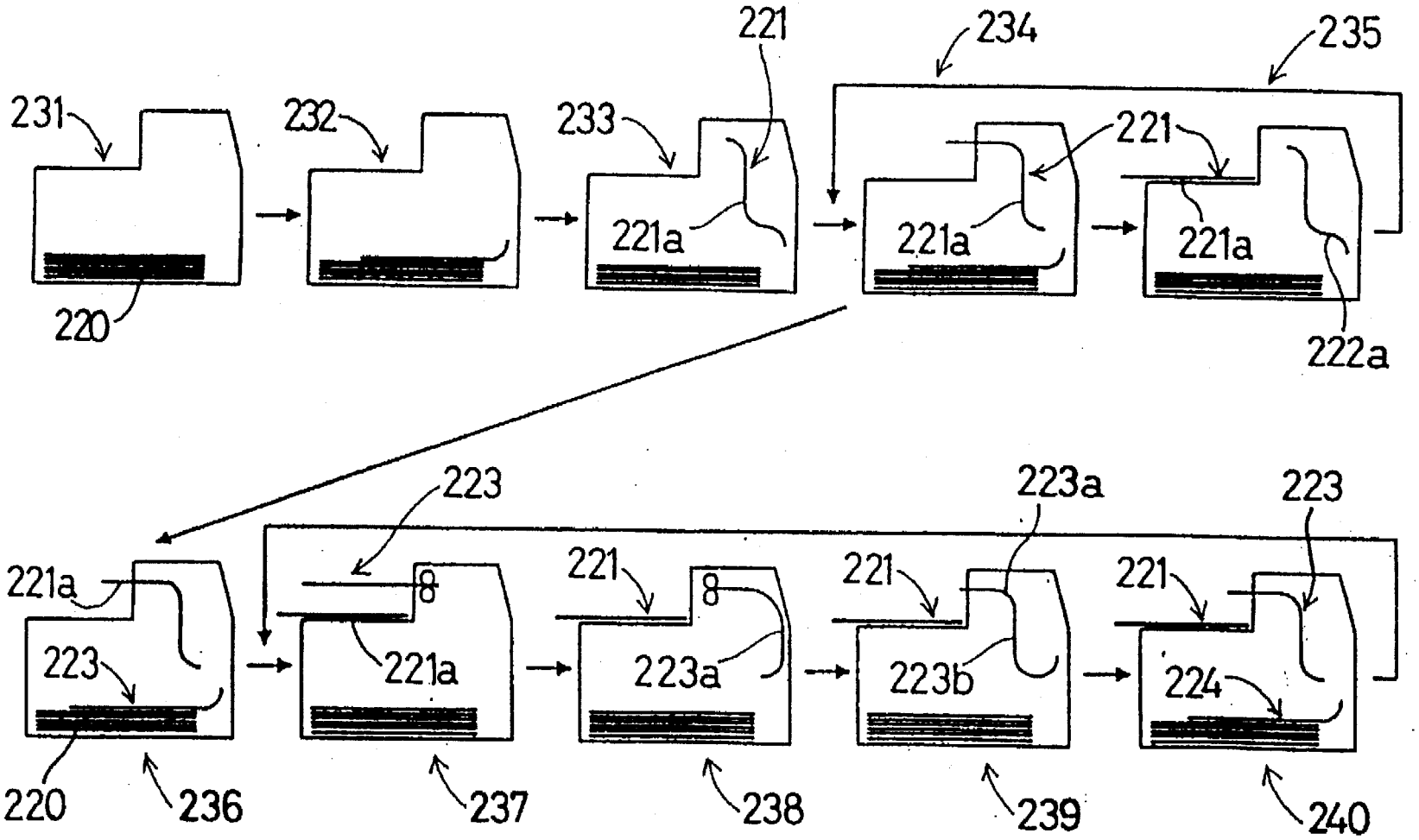
FIG. 13 is a simplified schematic diagram showing the procedure of transporting sheets when printing by means of the duplex printing apparatus of FIG. 1.

FIG. 13 is a simplified schematic drawing showing the sheet transporting procedure when printing by means of the duplex printing apparatus 50 of FIG. 1. In this schematic drawing, component elements of the apparatus 50 other than the chassis and paper sheets are omitted. In the apparatus, it is assumed that printing in the simplex printing mode is carried out and at least three toner images are printed. Printing of the toner images onto the sheet surfaces is carried out continuously. In FIG. 13, printing operation by switching to duplex printing mode amid the course of continuously printing toner images in simplex printing mode will be described.

Before starting to print, the duplex printing apparatus 50 houses a plurality of paper sheets 220 stacked in the feeding means 64, as indicated by state 231. When toner images are printed continuously in the simplex printing mode, the first sheet 221 is fed from the feeding means 58 to the first transport path L1 as indicated by state 232. At this time, the sheet 221 presses a movable piece of the sheet detecting means 85, thereby causing an output of sheet passage detection signal indicating that the sheet has passed the first transport path L1. When the sheet passage detection signal is given, the processing circuit 212 starts to count the time for the predetermined single-side feeding period by using, for example, a built-in timer. The single-side feeding period is a period of time not shorter than the time required for the sheet after passing the sheet detecting means 85 to pass through the first transport path L1 to reach the second transport path L2 and complete printing, and is equal to the time when the distance between the other edge of the first sheet and one end of the sheet which is fed next to the first transport path L1 becomes about 3 mm.

The sheet 221 which is fed passes the first transport path L1 and receives printing of a toner image on one face 221*a* thereof in the second transport path L2 as indicated by state 233. When printing is completed, the sheet 221 presses up the oscillating piece 73 and is transported to the discharge path L4. At this time, the detector 75 which detects the angular displacement of the oscillating piece turns on. When the detector status turns on, the processing circuit 212 drives the second drive roller 107*b* to rotate in the first rotating direction. At this time, counting of the single-side feeding time in the processing circuit 212 completes at approximately the same timing. Therefore, the feeding means 58 feeds the next sheet 222 to the first transport path L1. This status is shown in state 234.

The sheet 222 moves similarly to the sheet 111 and presses the movable piece of the sheet detecting means 85 to pass the first transport path L1 and reach the second transport path L2. As indicated by state 235, the sheet 222 which has reached the second transport path L2 receives the toner image printed on one side 222*a* thereof. At this time, the sheet 221 is discharged from the discharging path L4 and placed on the discharging tray 59. When another toner image is to be printed, an operation similar to that of state 234 is carried out again. Thereafter, in case printing of toner image in simplex printing is to be repeated, operations of state 234 and state 235 are repeated.

In case switching from simplex printing to duplex printing for printing of toner image is commanded when the apparatus is in one of states 231 through 235, status of the apparatus 50 shifts from state 234 to state 236. In state 236, similarly to the case of state 234, a sheet with printing of toner image thereon completed is discharged to the outside the apparatus 50 and, upon elapse of the single-side feeding time, the third sheet 223 is transported to the first transport path L1. At this time, the sheet 223 presses the movable piece of the sheet detecting means 85 to cause a sheet passage detection signal to be output. When the sheet passage detection signal is given, the processing circuit 212 starts to count the time for the predetermined both-side feeding period. The both-side feeding period is a period of time not shorter than the time required for the sheet, after passing the sheet detecting means 85, to complete printing of toner image on one or the other face thereof, and is equal to such a period that the distance between the other end of the sheet whereon printing is completed and one edge of the sheet to be fed next to the first transport path becomes about 3 mm.

Then the sheet 223 is transported to the second transport path L2 and toner image is printed on one side 223*a* thereof. At this time, the second sheet 222 is discharged from the apparatus 50 and placed on the discharge tray 59. When printing is completed, the sheet 223 presses up the oscillating piece 73 and is transported to the discharge path L4. At this time, the detector 75 which detects the angular displacement of the oscillating piece 73 turns on. When the detector turns on, the processing circuit 212 makes the second drive roller 107*b* to rotate in the first rotating direction for a predetermined transport time. This causes the second transporting means 76 to stop in a state of holding other edge of the sheet 223. This state is shown in the state 237.

The processing circuit 212 then makes the second drive roller 107*b* rotate in the second rotating direction. This causes the sheet 223 to move from the discharge path through the third transport path and transported to the first transport path in such a direction that the other face comes into contact with the photosensitive unit 54.

When the sheet 223 is transported to the first transport path again, the sheet 223 presses the movable piece of the sheet detecting means 85 to cause sheet passage detection signal to be output. When the sheet passage detection signal is given, the processing circuit 212 does not start counting of the double-side feeding time but continues counting of the double-side feeding time which was started when the previous signal was given. Periods of time required for the operation of printing an toner image on either one or the other side of a sheet transported to the first transport are identical. Therefore, the processing circuit 212 may also operate as follows; when the first detection signal is given, the processing circuit 212 does not start counting of the feeding time and, when two detection signals are given consecutively, starts counting of the single-side feeding time at the time when the second detection signal is given, thereby makes the second drive roller 107*b* rotate when the single-side feeding period has elapsed.

The sheet 223 thus transported is transported to the discharge path L4 after the toner image is printed on the other face 223*b* as indicated by state 239. At this time the detector turns on. When the detector turns on, the processing circuit 212 makes the second drive roller 107*b* rotate in the first rotating direction to discharge the sheet 223 to the outside of the apparatus 50. Almost simultaneously as this, counting of the both-side feeding time completes. Thus the feeding means 58 feeds the sheet 224 to the first transport path L1. When the toner image is to be printed further, the process returns to state 237 and operations similar to those of state 237 through 240 are carried out. Then operations of state 237 through 240 are repeated in case duplex printing of the toner image are to be continued.

Figure 14:
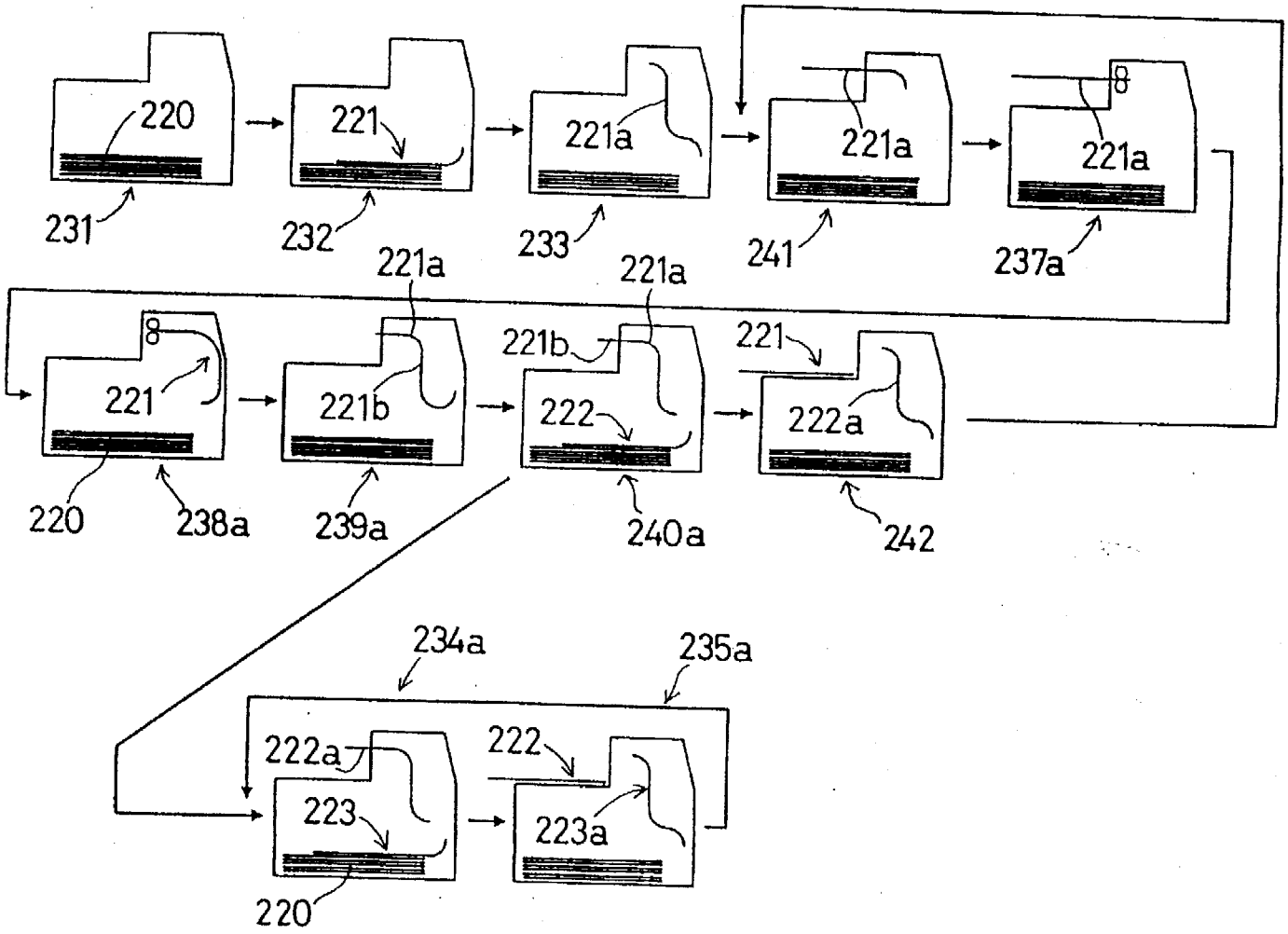
FIG. 14 is a simplified schematic diagram showing the procedure of transporting sheets when printing by means of the duplex printing apparatus of FIG. 1.

FIG. 14 is a simplified schematic diagram showing the procedure of transporting sheets when printing by using the duplex printing apparatus of FIG. 1. FIG. 14 is similar to FIG. 13, and therefore identical state will given the identical symbol with detailed description being omitted. A drawing showing the same state as a former one with only the symbol of sheet being different will be assigned a symbol with letter "a" added thereto, and detailed description will be omitted. FIG. 14 explains a state wherein printing of toner image in simplex printing is specified when printing of toner image in duplex printing is repeated.

When printing of toner image in duplex printing is started at a state 231 which is the state before printing is started, the apparatus undergoes the states 232 and 233 and prints the toner image on one face 221*a* of the sheet 221. The sheet with printing thereon completed presses up the oscillating piece 73 and is discharged through the discharging path L4. Because the detector 75 turns on at this time, the processing circuit 212 makes the second drive roller 107*b* rotate in the first direction for a predetermined period of time. This state is indicated by the state 241. Then the sheet 221 is transported through the third transport path to the first transport path again in the states 237*a* through 240*a*, and then receives the toner image printed on the other face 221*b*. And simultaneously with discharge of a sheet with printing thereon completed, next sheet 222 is fed. When printing of toner image in duplex printing mode is to be repeated, states 241, 237*a* through 240*a* and 242 are repeated. Feeding of sheets by the feeding means 58 is carried out every time the predetermined double-side feeding time has elapsed after passage of the first sheet 221 was detected by the sheet detecting means 85.

In case a command is given to switch the tone image printing mode from the duplex printing mode to simplex printing mode when the apparatus 50 is either in state 231 to 233, 241, 237*a* to 240*a* or 242, state of the apparatus 50 shifts from state 240*a* to 234*a*. Thereafter, while simplex printing is selected, states 234*a* and 235*a* are repeated to print the toner image on only one face of the sheets. At this time, the first sheet whereon the toner image is to be printed in simplex printing mode is printed after the double-side printing time has elapsed after passage of the last sheet whereon the toner image is to be printed in duplex printing mode was detected. Second and subsequent sheets whereon the toner image is to be printed in simplex printing mode are printed when the single-side printing time has elapsed after passage of the first sheet was detected.

As shown in FIG. 13 and FIG. 14, in the duplex printing apparatus 50 of this embodiment, in case printing of toner image in either duplex or simplex printing mode is commanded when printing of toner image in either duplex or simplex printing mode is repeated, it is possible to switch the printing mode to other mode without stopping the printing operation. Thus it is easy to switch the printing mode.

When image data of N pages is to be printed in duplex printing mode, it is preferable to print toner image corresponding to image data of the 2nth page on one face of the nth (n=1, 2, . . . , N/2) sheet and print the toner image of (2n−1)th page on the other face. In the duplex printing apparatus 50, as described previously, sheets are placed successively on the discharge tray with the side whereon the toner image was printed last facing downward. Therefore, in case toner images are printed as described above, printed sheets placed on the discharge tray after printing are collated in the page order of the data. Thus the pages can be collated. In case the number of pages is an odd number, it is preferable that only the last page is printed in simplex printing mode. With this arrangement, unlike the apparatuses of the prior art, the sheets up to the last page can be collated without passing the sheets through the paths L1 through L4 again while not printing.

Figure 15:
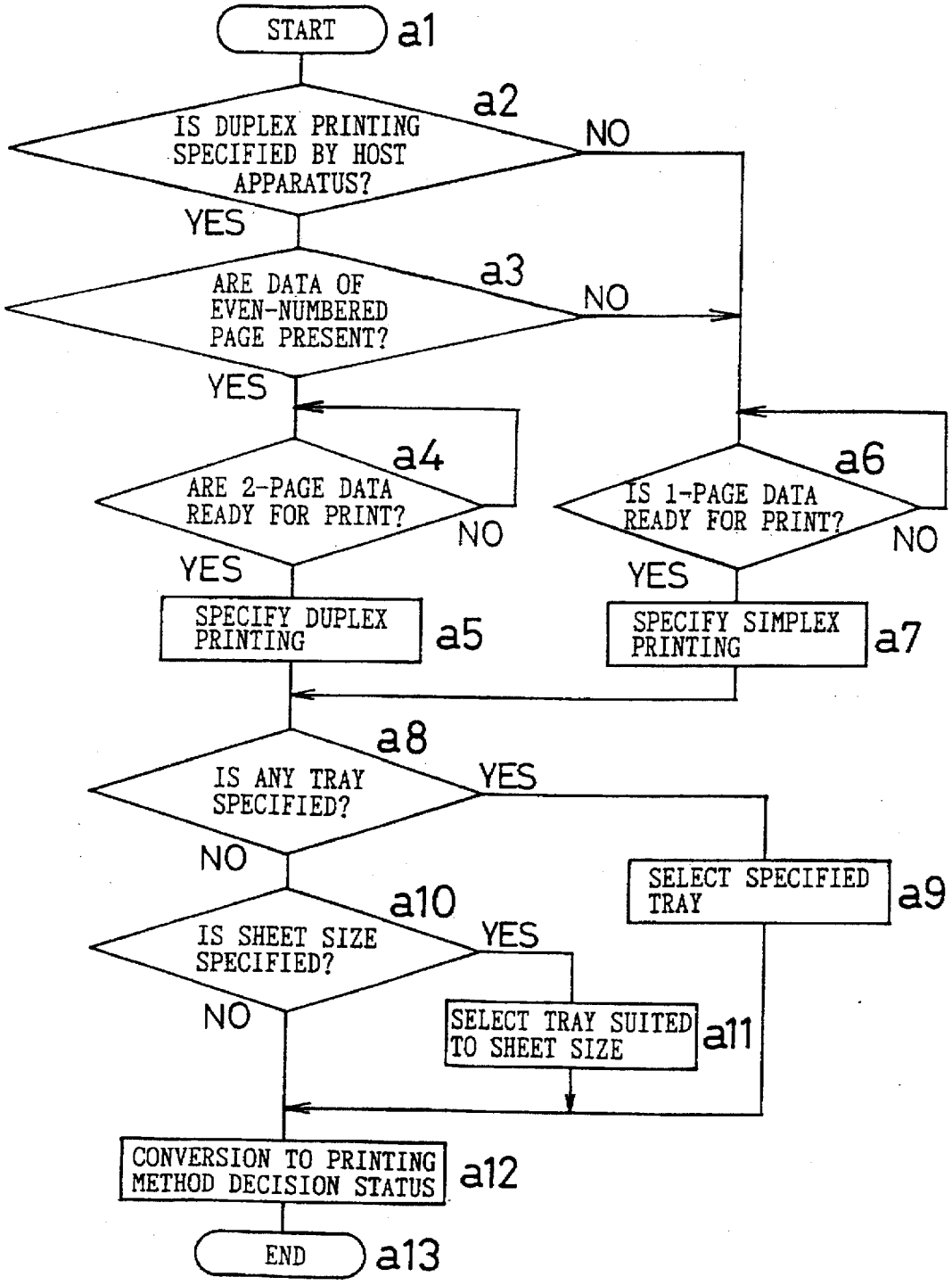
FIG. 15 is a flow chart explaining the method of generating printing method determination status in an interface 211 of the duplex printing apparatus 50.

FIG. 15 is a flow chart explaining the method of generating the printing method decision status in the interface 211 of the duplex printing apparatus 50. The apparatus 50 determines the operation status of each component element of the apparatus 50 according to this status.

When printing data is given from the host apparatus 201, the process proceeds from step a1 to step a2. The printing data includes image data to be printed and additional data indicating the specified conditions relating to printing of the image data. A single set of printing data may include image data for the 1st through Nth pages. In step a2, it is decided, based on the printing data, whether the host apparatus specifies duplex printing or not. If duplex printing is specified, image data of two pages are processed at a time as image data of pages 1 and 2, then image data of pages 3 and 4, and so on. In case duplex printing is specified, process proceeds from step a2 to step a3.

In step a3, it is determined whether the 2-page image data to be processed includes image data of an even-numbered page. In case the Nth page, the last page, is odd-numbered, for example, the 2-page image data including the last page does not include image data of even-numbered page. Other sets of 2-page image data include image data of even-numbered pages. In case the Nth page which is the last page is even-numbered, for example, every set of 2-page image data includes image data of even-numbered page.

When image data of even-numbered page is included, the process proceeds from step a3 to step a4 where it is determined whether data to be obtained by developing the 2-page image data to be processed for generating toner images in the developing/image transferring means has been prepared or not. This data is obtained by developing 2-page data to be processed, for example. When it is not prepared, judgment process in this step is repeated until it is prepared. When it is determined that the data is prepared, the process proceeds to step a5 where printing of the data in duplex printing mode is specified. When the specifying process is complete, the process proceeds from a5 to step a8.

In case it is determined in step a2 that the host apparatus did not specify duplex printing, the process proceeds from step a2 to step a6. Also in case it is determined in step a3 that there is no data in even-numbered page, the process proceeds from step a3 step a6. In step a6, it is determined whether data fox generating a toner image of one page has been prepared from the image data, which should correspond to two pages, or not. When it has not been prepared, this judgment process is repeated until the preparation is completed. When the preparation is completed, the process proceeds to step a7 where printing of the data in simplex printing is specified. When the specifying process is complete, the process proceeds from a7 to step a8.

In step a8, it is determined whether the additional data supplied from the host apparatus 201 includes the conditions to select a sheet tray or not. In the apparatus 50 of FIG. 1, for example, a sheet feeding tray is selected from among the sheet tray of the feeding means 58 and the manual feeding port where sheets are fed one by one from the outside of the apparatus 50 onto the first transport path L1. The sheet tray whereon sheets are placed may also be installed in plurality so that sheets of different sizes can be placed. In case conditions to select a tray is specified by the host apparatus 201, the process proceeds from step a8 to step a9 where it is specified to print toner images by using the sheets which are placed on the selected tray. In case it is determined in step a8 that conditions to select a tray is not specified, the process proceeds from step a8 to step a10.

In step a10, it is determined whether the additional data supplied from the host apparatus 201 includes conditions for selecting the size of sheets whereon the data is to be printed, or not. In case conditions for selecting the size of sheets are specified from the host apparatus 201, the process proceeds from step a10 to step all where the tray whereon sheets of the selected size are placed is selected and printing of toner images on the sheets of the tray is specified. In case it is determined in step a10 that conditions to select sheet size is not specified, the process proceeds from step a10 to step a12. At this time, sheets predetermined in the apparatus 50 is used as the sheets whereon the data is printed. As the predetermined sheets, for example, the sheets placed in the feeding means 58 are selected.

The process concerning specifying the printing mode and the sheet proceed, when it is completed for all image data included in the printing data, from steps a9 through a11 to step a12. In step a12, the information related to the printing mode and sheet specified in the process described above is converted to generate printing method decision status. When the status is generated, the process proceeds from step a12 to step a13 to complete the processing operations of this flow chart.

Figure 16:
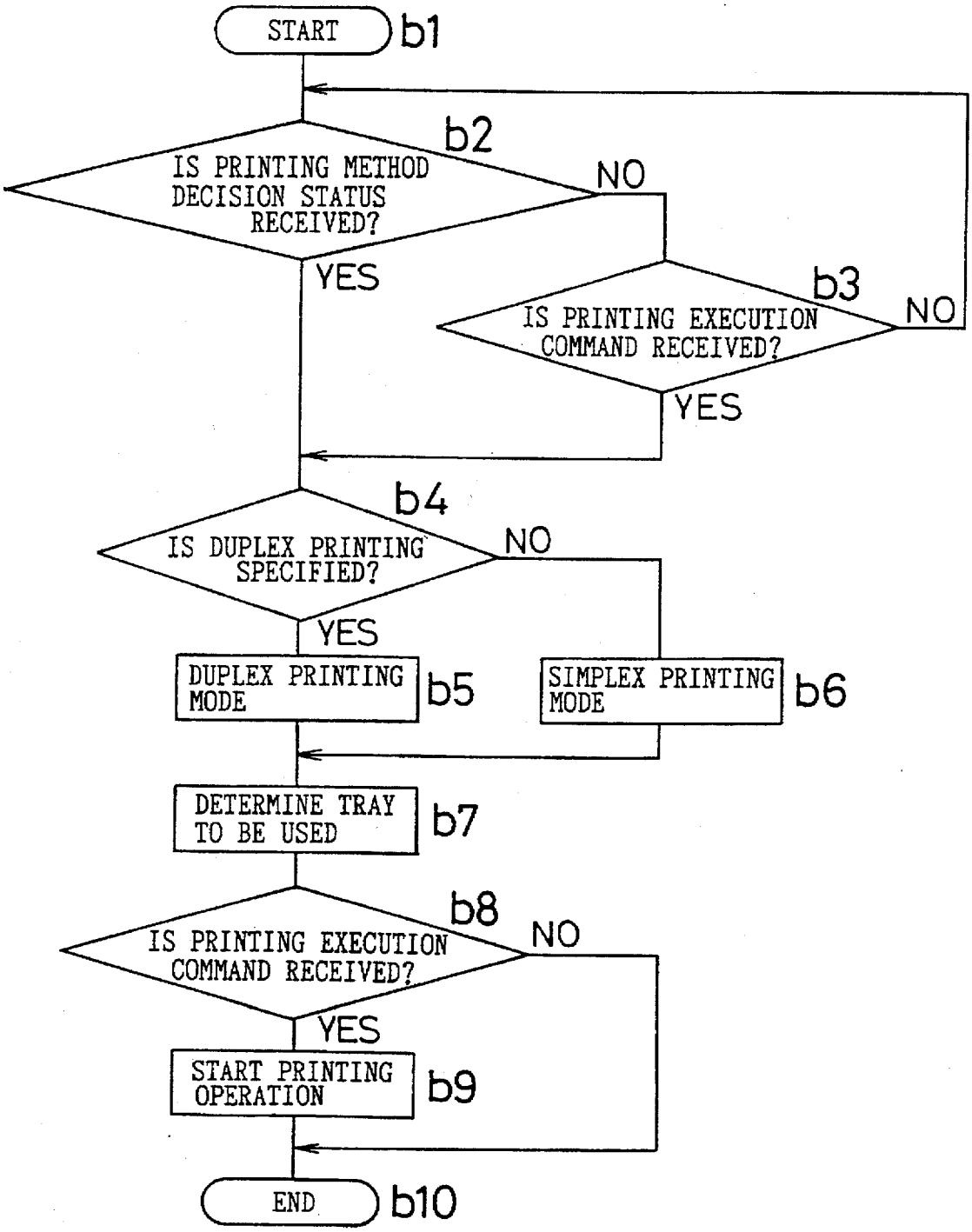
FIG. 16 is a flow chart explaining the print starting operation in a processing circuit 212 of the duplex printing apparatus 50.

FIG. 16 is a flow chart explaining the print starting operation in the processing circuit 212 of the duplex printing apparatus 50. When the printing method decision status is generated according to the flow chart of FIG. 15, the process proceeds from step b1 to step b2. In step b2, it is determined whether the processing circuit 212 has received the printing method decision status from the interface 211 or not. In case the printing method decision status has not been received, the process proceeds from step b2 to step b3, where it is determined whether the processing circuit 212 has received print execution command from the interface 211 or not. In case both the status and the printing execution command have not been received, the process returns from the step b3 to step b2 to repeat the judgment until either one is received. When either the status or the command is received, the process proceeds from steps b2, b3 to step b4.

In step b4, it is determined whether duplex printing apparatus is specified or not according to the status. In case duplex printing apparatus is specified, mode of the apparatus 50 is switched to duplex printing mode in step b5. In case duplex printing apparatus is not specified, the mode is switched to normal printing mode in step b6. In case the status is not given, the mode is switched to the mode which is preset in the apparatus 50. Alternatively, the apparatus 50 may be provided with means for determining which mode should be selected when no status is given, thereby to switch the mode according to the selection by the means. When the mode is determined, the process proceeds from steps b5, b6 to step b7.

In step b7, the tray to be used is determined according to the status or the setting of the apparatus 50 to make the feeding means 58 feed the sheets from the tray. When the tray is determined, the process proceeds from step b7 to step b8. In step a8, it is determined whether the print execution command is received from the interface. When the command is received, the process proceeds to step b9 to start printing operation in the printing mode which is set and the process proceeds to step b10 to complete the processing operation of the flow chart. In case print execution command is not received, the process proceeds from steps b8 to step b10 to complete the processing operation of the flow chart.

Figure 17:
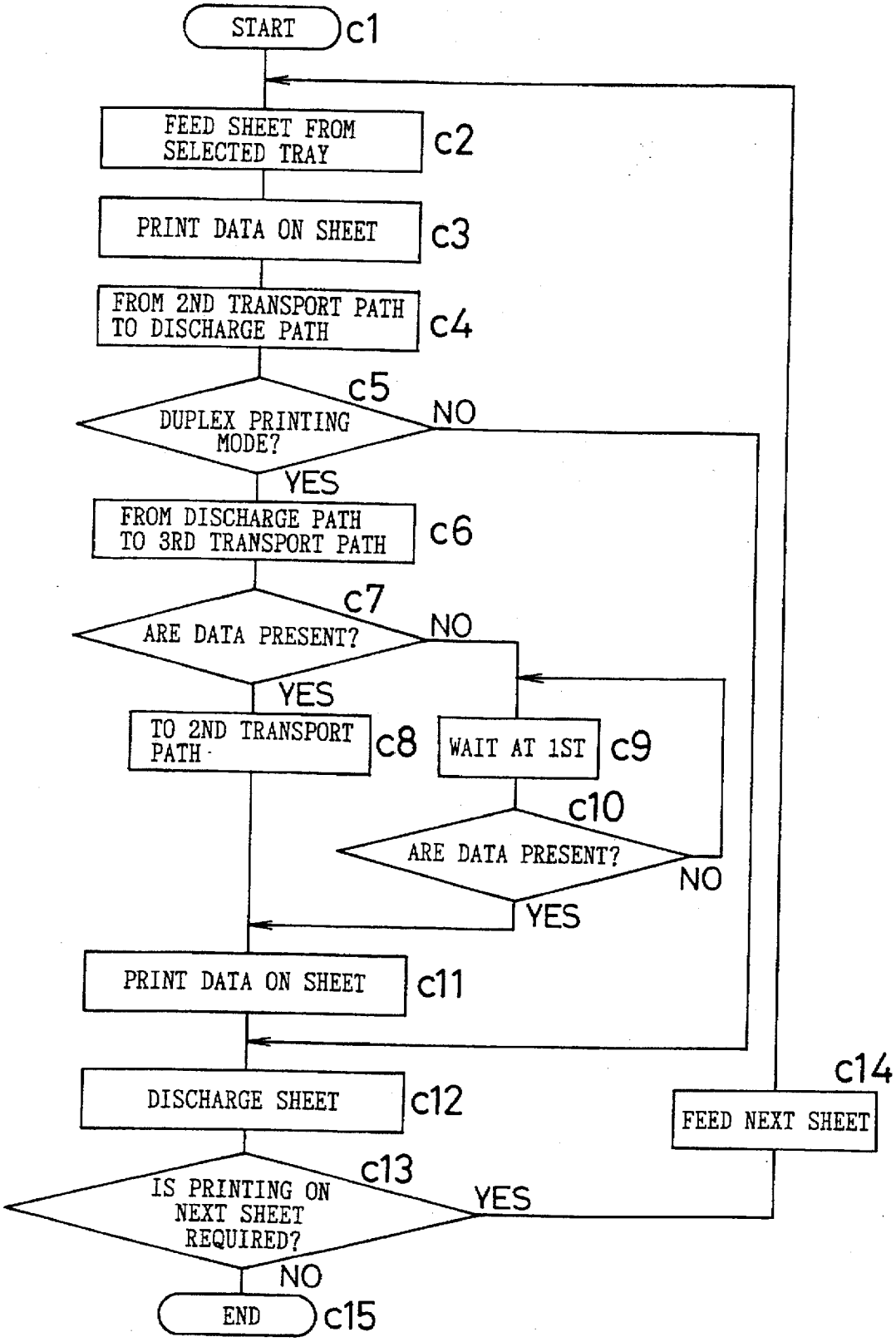
FIG. 17 is a flow chart explaining the print starting operation in a processing circuit 212 of the duplex printing apparatus 50.

FIG. 17 is a flow chart explaining the printing operation in the duplex printing apparatus 50. When printing operation is started in step b9 of the flow chart of FIG. 16, the process proceeds from step c1 to step c2.

In step c2, sheets are supplied from the selected tray to the first transport path L1. Then the process proceeds to step c3 where the data to be printed which has been generated as the data which represents the toner image is developed, transferred onto the sheet and fixed. This causes the toner image corresponding to the data to be printed on one face of the sheet. Then the process proceeds to step c4 where the sheet is transported from the second transport path to the discharge path. This is followed by step c5 where it is determined whether the printing mode is duplex printing mode or not. In case the mode is duplex printing mode, the process proceeds from step c5 to step c6 where the sheet is transported from the discharge path to the third transport path and turned up side down. Then the process proceeds to step c7 where it is determined whether there is data to be printed on the other side of the sheet. In case there is data, the process proceeds to step c8 where the sheet is transported to the second transport path. In case there is not printing data, the process proceeds to step c9 to make the sheet wait on the upstream side of the first transporting means in the direction of the sheet flow. The process proceeds from step c9 to step c10 where it is determined whether there is data to be printed on the other face of the sheet. In case there is not data, the process returns to step c9 to repeat this judgment process until data is supplied. In case there is data, the process proceeds to step c11. Also in case it is determined in step c7 that there is printing data and the sheet is transported to the second transport path, the process proceeds to step c11.

In step c11, the obtained data is printed on the other face of the sheet. Thus a printed sheet is generated with toner images printed on one and the other faces thereof. When printing of toner images in duplex printing mode is completed, the process proceeds from step c11 to step c12. In case the printing mode is simplex printing mode, because printing of the toner image is completed in step c4, the process proceeds from step c5 to step c12. In step c12, the sheet is discharged from the apparatus 50. Upon discharge of the sheet, the process proceeds from step c12 to step c13 where it is determined whether there is data to be printed and printing request for the next sheet is given or not. In case the request is given, the next sheet is fed in step c14 and then the process returns to step c2. In case there is not a printing request, it is determined that printing of all data is completed and the process proceeds from step c13 to step c15 to complete the processing operations of the flow chart.

Printing of toner images in simplex printing and duplex printing can be carried out in the operations described above.

When repeating the printing of toner images in simplex and duplex printing as described above, printing operation may be interrupted due to data transmission failure or other cause. In such a case, the interface 211 gives automatic sheet discharge information to the processing circuit 212 to have all sheets present in the paths L1 through L4 in the apparatus 50 automatically discharged to the outside of the apparatus 50.

Figure 18:
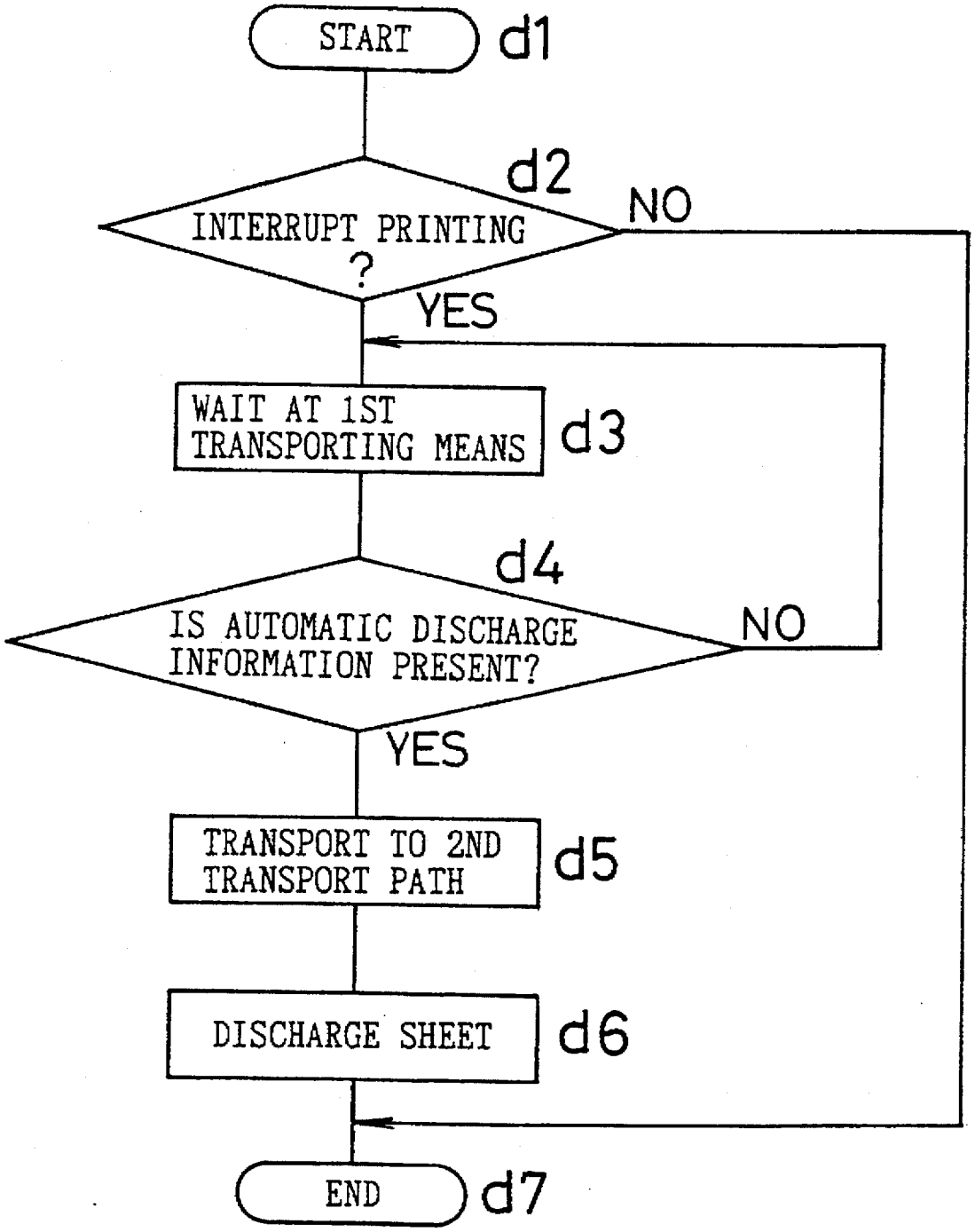
FIG. 18 is a flow chart explaining the automatic sheet discharging operation in the duplex printing apparatus 50.

FIG. 18 is a flow chart explaining the automatic discharge operation in the duplex printing apparatus 50. The process proceeds from step d1 to step d2 where the interface 211 is in such a state that data is not received from the host apparatus over a specified period of time and it is determined whether to stop printing or not. When it is determined to stop printing, the process proceeds to step d3 where the processing circuit 212 makes the sheets which are left in the paths L1 through L4 in the apparatus 50 wait in the first transport path L1, then the process proceeds to step d4. In step d4, it is determined whether automatic discharge information is given or not. In case the information is not given, the process returns to step d3 where the judgment process is repeated until the information is given. When the information is given, the process proceeds from step d4 to step d5 where the waiting sheet is transported through the second transport path, to be discharged to the outside of the apparatus in step d6. Thus having the sheet automatically discharged, the process proceeds from step d6 to step d7 to complete the processing operations of the flow chart. In case the printing operation is not interrupted, the process proceeds from step d2 directly to step d7 to complete the processing operations.

Figure 19:
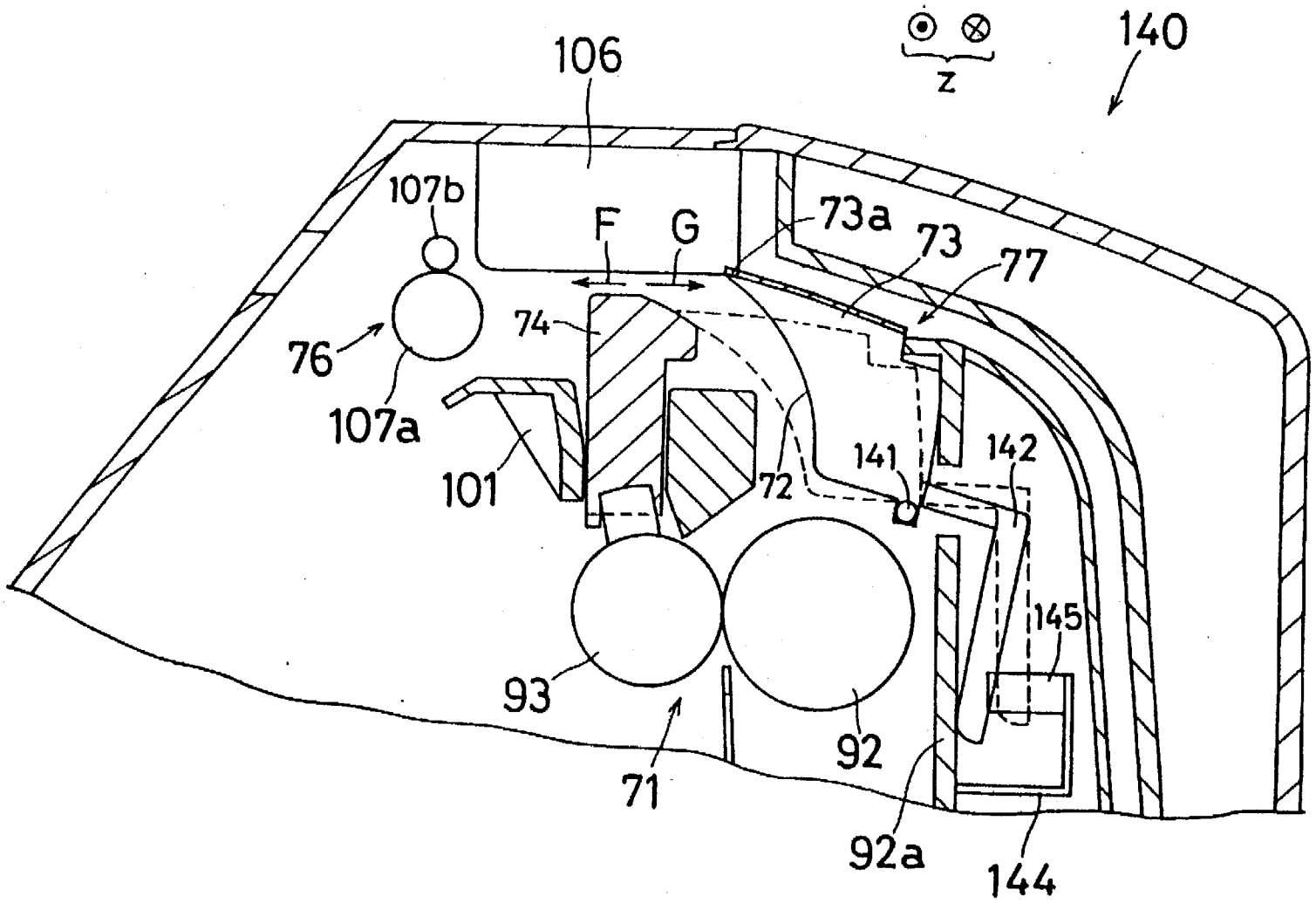
FIG. 19 is a sectional view showing part of the configuration of a duplex printing apparatus 140 of a second embodiment of the invention.

FIG. 19 is a sectional view showing a part of a duplex printing apparatus 140 of a second embodiment of the invention. The duplex printing apparatus 140 has a similar configuration as that of the duplex printing apparatus 50 of the first embodiment, and therefore identical component elements will be identified by identical numerals with description thereof will be omitted.

An oscillation shaft 141 of the oscillating piece 73 of the third guiding member 77 is installed at the lower portion of the right side portion on the downstream side in the refeeding direction G. Installed in a portion adjacent to the upper portion of the oscillation shaft 141 of the oscillating piece 73 is an actuator 142 which protrudes in an inverted L shape from the portion. Installed to extend between the actuator 142 and the fixing means 71 is a mounting frame 92*a*. Installed in a portion of the mounting frame 92*a* opposing the free end portion which is the lower end portion of the actuator 142 is a mounting section 144. Installed on the mounting section 144 is a detector 145. The detector 145 and the actuator 142 are included in the detecting means 75*a*.

The detector 145 can be realized, for example, by an optical sensor having a light emitting element and a light receiving element in this embodiment. In the state that the tip 73*a* of the oscillating piece 73 is held by the cleaner 74 as indicated by a dashed line in FIG. 19, a free end portion of the actuator 142 intercepts between the light emitting element and the light receiving element of the optical sensor. At this time the detector 145 turns off. Therefore the detecting means 75*a* also turns off. When the sheet 60 is transported from the fixing means 71, one edge of the sheet 60 comes into contact with the third guide surface 72 of the oscillating piece 73. When the sheet 60 is transported further, the oscillating piece 73 is lifted by the rigidity of the sheet 60 to make an angular displacement in a direction to reach the position indicated by a solid line in FIG. 19. This causes the free end portion of the actuator 142 to depart from the optical sensor. Thus the light receiving element receives the light from the light emitting element. At this time, because the detector 145 turns on, the detecting means 75*a* also turns on.

When the other edge of the sheet 60 passes the third guiding means 77, the oscillating piece 73 makes an angular displacement in such a direction as to return to the position indicated by the dashed line in FIG. 19. This causes the actuator 142 to intercept between the light emitting element and the light receiving element of the optical sensor again. Thus the optical sensor turns off. As the optical sensor turns off, the detector 145 detects passage of the sheet 60 through the third guiding means 77.

The oscillation shaft 141 of the oscillating piece 73 is installed at a position departed from the position where the sheet comes into contact. Distance between this position and the position where the sheet comes into contact is greater than the distance between the oscillation shaft 96 of the oscillating piece 73 and the position where the sheet comes into contact in the first embodiment. This arrangement increases the rotation moment exerted on the oscillating piece 73. Consequently, it is made easier for the oscillating piece 73 to make an angular displacement. It is preferable that the oscillation shaft 141 is not located on the extended line of the direction where the sheet 60 come into contact with the third guide surface 72.

The actuator 142 balances the oscillating piece 73 so that the oscillating piece 73 makes an angular displacement when the force with which the sheet 60 presses the third guiding surface 72 is not less than 1 gram-weight and within 10 gram-weight. The force with which the sheet 60 presses the third guiding surface 72 is required to be 1 gram-weight or greater, so that the tip of the oscillating piece 73 can move down stably by the weight of the oscillating piece 73.

Figure 20:
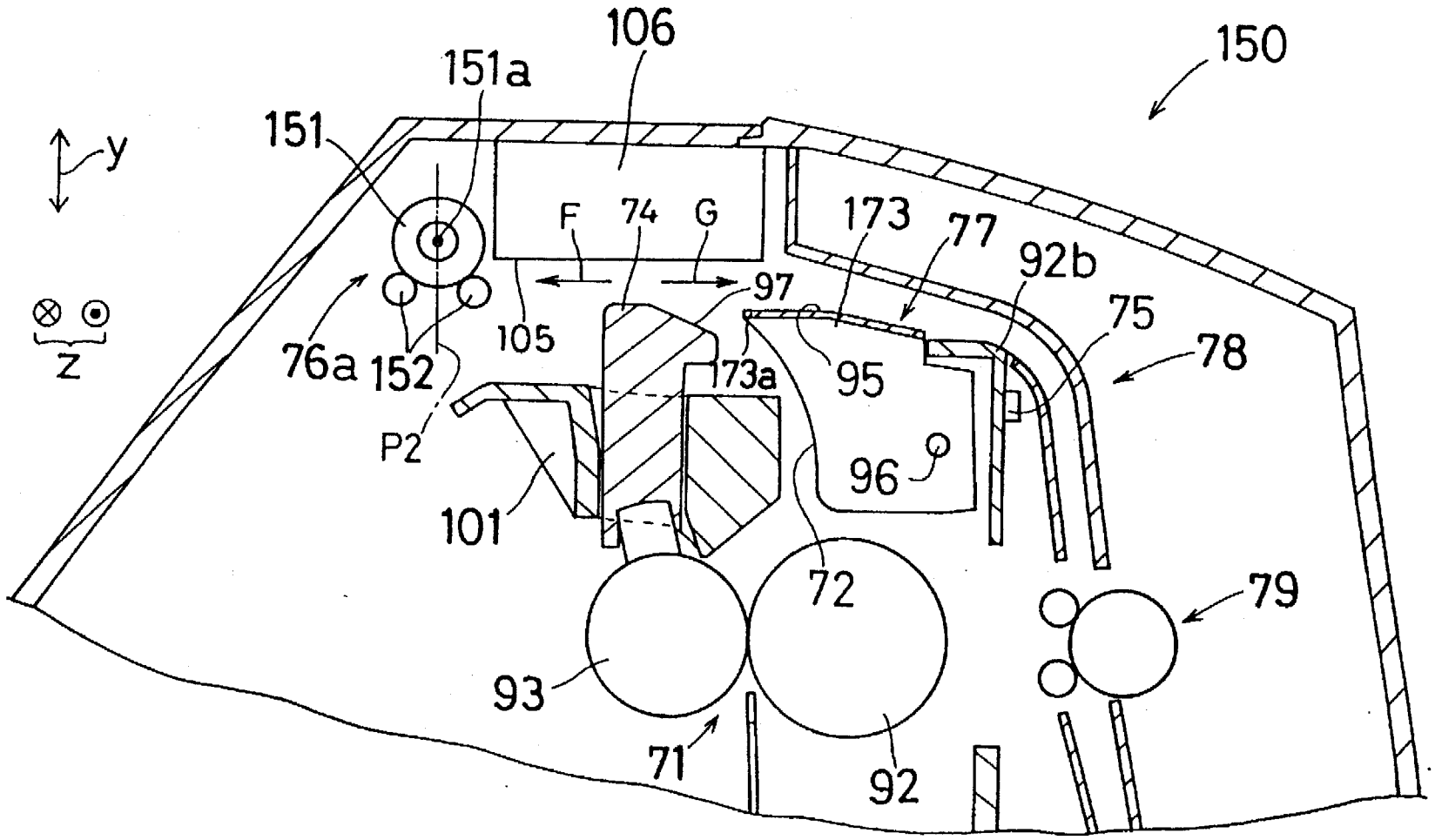
FIG. 20 is a sectional view showing part of the configuration of a duplex printing apparatus 150 of a third embodiment of the invention.

FIG. 20 is a sectional view showing a part of the duplex printing apparatus 150 of a third embodiment of the invention. The duplex printing apparatus 150 has a similar configuration as those of the duplex printing apparatuses 50 and 140 of the first and the second embodiments, and therefore identical component elements will be identified by identical numerals with description thereof will be omitted.

The second transporting means 76*a* has a first drive roller 151 and a pair of second correcting rollers 152. The first drive roller 151 is installed in an upper portion with respect to the discharge path L4. The roller 151 is driven to rotate selectively in either the first or the second rotating direction by the rotation drive source 115. The second correcting rollers come into contact with the first drive roller 151 from below. The first rotating direction is such a direction as the sheet 60 held between the rollers 151 and 152 can be transported in the discharging direction F. The second rotating direction is such a direction as the sheet 60 held between the rollers 151 and 152 can be transported in the discharging direction F.

The second correcting rollers 152 are installed so that the center axes of the rotation thereof are inclined by the same angles from a plane P2. The plane P2 is a plane which includes the rotation axis 151*a* of the first drive roller 151 and is parallel to the direction wherein the gravity indicated by the arrow y acts. The relationship between the diameters and angles of the first drive roller 151 and the second correcting rollers 152 satisfy conditions similar to the relationship between the diameters and angles of the second drive roller 112 and the first correcting rollers 113.

Therefore, the sheet 60 which is curled by the fixing means 71 is warped, by the first drive roller 151 and the second correcting rollers 152, in the opposite direction to the curl caused by the fixing means 71. Thus the curl of the sheet 60 is corrected. When the sheet 60 is transported in the refeeding direction G, the other edge of the sheet 60 is directed upward by the first drive roller 151 and the second correcting rollers 152. Consequently the sheet 60 is guided along the upper guide surface 105. Because the other edge of the sheet 60 is guided above the third guiding means 77 as described above, the other edge can be prevented from being inserted between the oscillating piece 73 and the cleaner 74 and returning to the second transport path L2 again. Thus the sheet 60 can be refed stably and printed on both sides thereof.

In the apparatus of the first embodiment, the oscillating piece 73 is installed to be free to make angular displacement around the oscillation shaft 96 so that the portion around one end portion 73*a* of the oscillating piece 73 departs from the cleanel 74 only when the oscillating piece 73 is pressed up by the sheet 60 which is transported by the fixing means 71 upward on the second transport path L2. In this embodiment, a fixed member 173 which is fixed on the mounting frame 92*b* is used instead of the oscillating piece 73. One end portion 173*a* of the fixed member 173 departs from the fourth guide surface 97 of the cleaner 74 leaving a narrow gap where the sheet 60 can pass.

The fixed member 173 has a configuration and a shape similar to those of the oscillating piece 73 of the first embodiment. The fixed member 173 has a plurality of ribs arranged with a space from each other in the direction of rotation axis indicated by the symbol z, with he ribs being installed on the shaft 96. Formed on the left side of each rib is a third guide surface 72. Installed on the upper side of the ribs in the direction perpendicular to the ribs is a flat plate which forms a guide surface 95.

When the fixed member 173 is used, it becomes difficult to use the detector 75 which detects passage of the sheet 60 with fixing of toner image thereon being completed, between the oscillating piece 73 and the cleaner 74. To control the timing of switching the rotating direction of the first drive roller 151 in this case, for example, techniques as described below are employed. In the first technique, after the sheet 60 has passed the sensor 86 of the sheet feed detecting means 85, required period taken by the other end of the sheet 60 to reach immediately before the second transporting means 76 is counted in advance. After the sheet 60 has passed the sensor 86, time is counted with a timer. When the required period has passed, rotating direction of the first drive roller 151 is reversed. In the second technique, in relation to the discharge path L4, a sensor is installed to detect that the other edge of the sheet 60 has reached immediately before the second transporting means 76. When this sensor detects the other edge of the sheet 60, the first drive roller 151 is driven in the reversed direction.

In case the third guiding means 77 is constituted as described above, it becomes unnecessary to press up the oscillating piece 73 with the sheet 60. Therefore, in the duplex printing apparatus including this configuration, possibility of jamming is reduced even when the sheet 60 is thin and weak paper.

Figure 21:
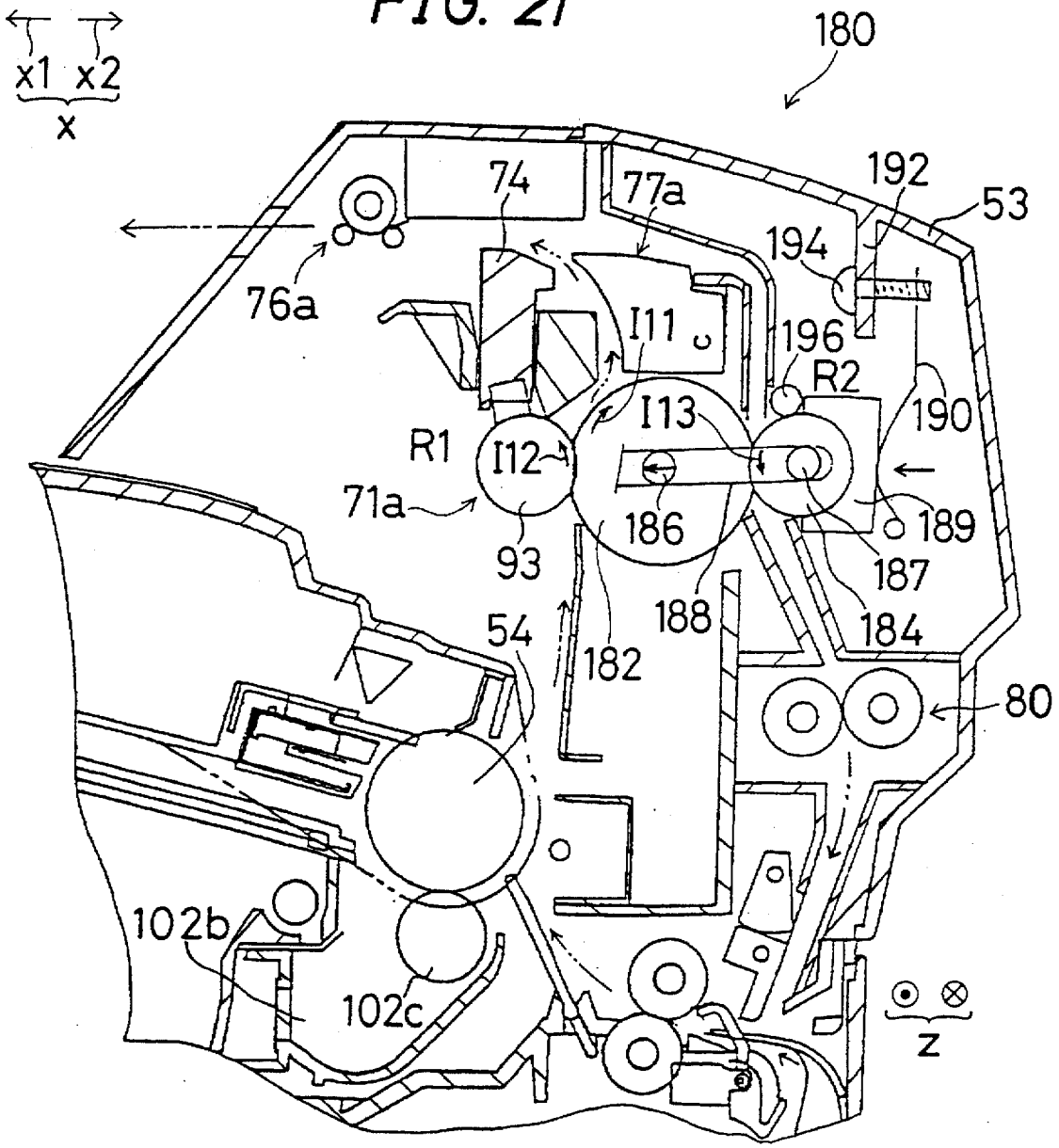
FIG. 21 is a sectional view showing part of the configuration of a duplex printing apparatus 180 of a fourth embodiment of the invention.
Figure 22:
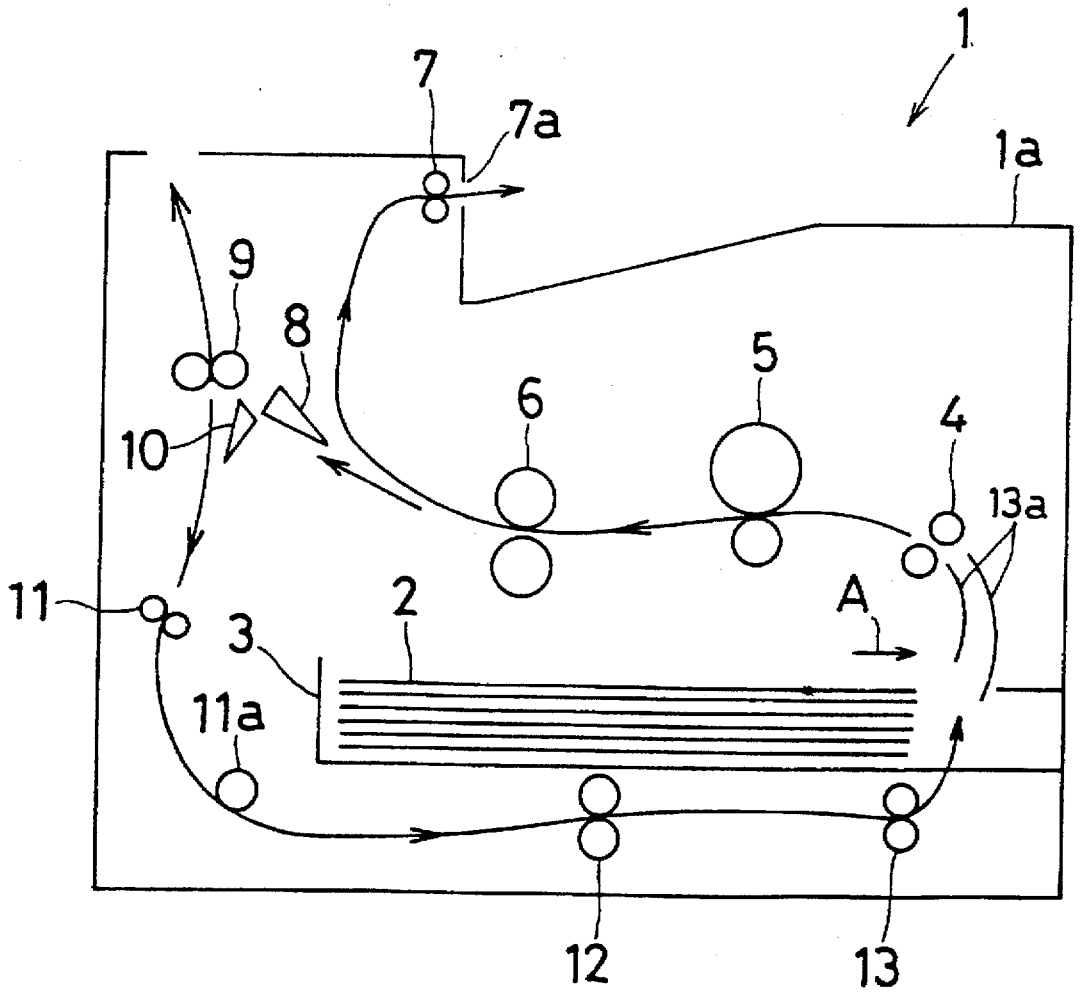
FIG. 22 PRIOR ART
FIG. 22 is a sectional view showing the printing apparatus 1 of the first prior art in a simplified form.
Figure 23:
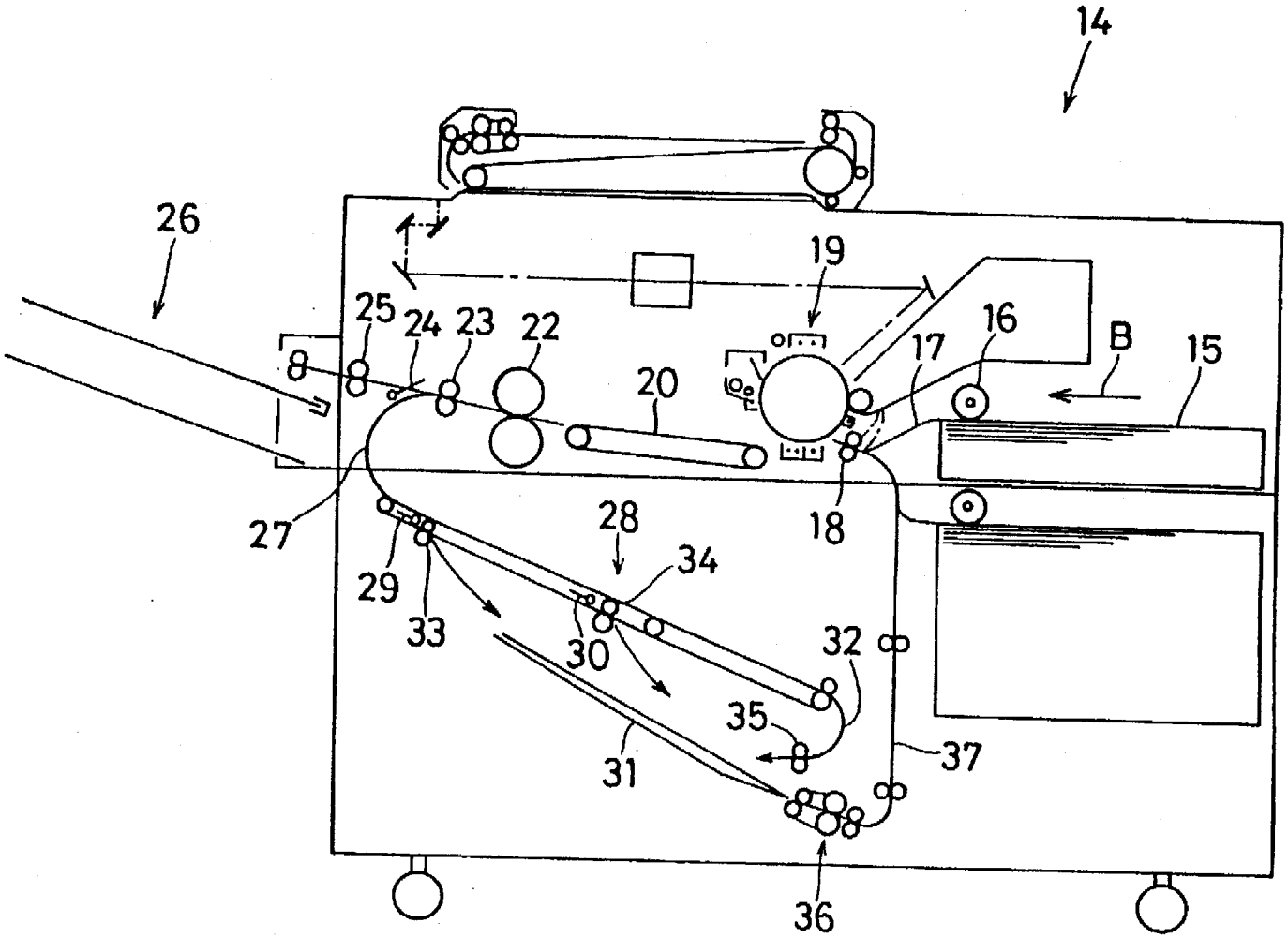
FIG. 23 PRIOR ART
FIG. 23 is a sectional view showing the image forming apparatus 14 of the second prior art.

FIG. 21 is a sectional view showing part of a duplex printing apparatus 180 of a fourth embodiment of the invention. The duplex printing apparatus 180 has a similar configuration as those of the duplex printing apparatuses 50, 140 and 150 of the first through the third embodiments, and therefore identical component elements will be identified by identical numerals with description thereof will be omitted.

Installed in the second transport path L2 is fixing means 71*a* comprising a pressure roller 182 and a thermal roller 93. The pressure roller 182 is installed between the second transport path L2 and the third transport path L3. The thermal roller 93 is installed at a position facing and in contact with the pressure roller 182 interposing the second transport path L2.

Installed at a position facing and in contact with the pressure roller 182 interposing the third transport path L3 is a cylindrical correcting roller 184. The correcting rollers 184 corrects curl of the sheet which is transported on the third transport path L3. The correcting roller is preferably made of a heat-resistant and heat-insulating resin such as, for example, PPS (polyphenylen sulfide). This makes it possible to prevent the pressure roller 182 from losing heat and improve the fixation degree of toner image in the fixing means. In case the correcting roller 184 is made of a metallic material, it is desirable to make at least a bearing 189 of a heat insulating material from a heat-insulating material.

Also when the correcting roller 184 made of a metal is used, it is preferable to insert a heating means such as a heater into the center of the roller 184 thereby to control the temperature of the correcting roller 184. When such heating means for the correcting roller 184 is installed, the correcting roller can be prevented from taking heat out of the pressure roller 182. Thus such a problem can be prevented that temperature of the pressure roller 182 lowers and fixation degree in the fixing means 71*a* decreases.

The pressure roller 182 is driven to rotate by a motor, for example. When the pressure roller 182 rotates, the thermal roller 93 and the correcting roller 184 are driven to rotate. Curvatures of the rollers 93, 184 are smaller than the curvature of the pressure roller 182.

The correcting roller 184 and the thermal roller 93 are located at positions to oppose each other interposing the pressure roller. When the pressure roller 182 rotates in only one predetermined direction indicated by the arrow I11, the rollers 93, 184 rotate in the desired directions indicated by the arrows I12, I13. The rotating directions I12, I13 are directions where the sheet 60 transported between the rollers 93, 184 can be transported in the second transporting direction and the refeeding direction.

The length of the rotary shaft 186 of the pressure roller 182 and the rotary shaft 187 of the correcting roller in the direction z are longer than the length of the rollers 182, 186 in the directions of the rotation axes thereof. Formed on both ends of rotary shafts are support members 188. The support member 188 has a groove of a predetermined length formed thereon, and both ends of the rotary shafts 186, 187 are fitted in these grooves freely slidably. The correcting roller 184 is supported by a bearing 189 from the right side opposite to the third transport path L3. The bearing 189 is energized in the direction of arrow x1 by a spring member 190. The spring member 190 is realized by, for example, a leaf spring, and is fixed by a screw 194 on a protruding portion 192 of the chassis of the front door 53.

When the bearing 189 is energized by the spring member 190 in the direction of the arrow x1, the rotary shaft 187 of the correcting roller 184 displaces in the direction of arrow x1 along the groove of the support member 188. The pressure roller 182 is pressed by the correcting roller 184 in the direction of the arrow x1. Therefore, the rotary shaft 186 is displaced in the direction of the arrow x1 along the groove of the support member 188. Consequently, contact pressure between the pressure 182 and the thermal roller 93 and the contact pressure between the pressure 182 and the correcting roller 184 vary depending on the force of energizing by the spring member 190. For example, contact pressure between the pressure roller 182 and the thermal roller 93 and the roller 182 pressure between the pressure roller 182 and the correcting roller 184 are equal to each other. And these contact pressures are proportional to the force of energizing the bearing 189 by the spring member 190.

Fixation of toner image improves as the contact pressure increases when the sheet 60 passes through the rollers 93 and 182. The degree of curl given when the sheet 60 passes between the rollers 93, 182 and 182, 184 increases as the contact pressure of rollers increases. Therefore, as the spring member 190 energizes in the direction of the arrow x1, the greater this force, the higher the fixation degree of toner image. At this time, the degree of curl increases as the fixation degree increases. However, the contact pressure between the rollers 93 and 182 increases by the same amount of increase in the contact pressure between the rollers 182 and 184. Therefore, the degree of curl increases in a direction opposite to the curl given to the sheet 60 between the rollers 182 and 184.

Therefore, when the contact pressure is changed to change the fixation degree of the toner image, the degree of curl can be adjusted in linkage with adjustment of the fixation degree of the toner image. Consequently, the degree of the curl given by the fixing means 71*a* and the degree of the curl given between the rollers 182 and 184 can be easily adjusted. Thus excessive curling in the opposite direction by the correcting rollers 184 can be prevented from occurring.

The correcting roller 184 is further provided with a cleaning roller 196 which comes into contact with the surface thereof. The cleaning roller 196 comes into contact with the correcting roller 184 and is driven thereby, and removes contamination of the surface of the cleaning roller 196. This makes it possible to keep the contact surface of the correcting roller 184, which touches the images immediately after fixing, always clean. Therefore, the surface of the sheet 60 whereon an image is printed can be prevented from being contaminated. The cleaning roller 196 is located at position at the right side of the apparatus 180 with respect to the third transport path L3, where operations of the bearing 189 and the spring member 190 are not affected.

Curvature R1 of the correcting roller 184 and the curvature R2 of the pressure roller 182 are selected to satisfy the following inequality.

$$0.5 \leqq (R1/R2) \leqq 1.0 \quad (3)$$

When the sheet 60 is passed between a pair of rollers which contact each other and rotate, the sheet 60 bends to conform with the surface of the roller of the smaller curvature among the pair of rollers, thereby to be discharged from between the rollers. At this time, the sheet 60 is curled to the degree corresponding to the curvature of the roller having smaller curvature the degree of curl increases as the curvature of the roller whereon the sheet 60 is wound becomes smaller. Because the correcting roller 184 is driven by the pressure roller 182, the above ratio (R1/R2) is preferably near 1.

The degree of curl of the sheet 60 also varies depending on the contact pressure between the pair of rollers and the temperature of the rollers. The greater the contact pressure, the greater the degree of curl. And the higher the temperature, the greater the degree of curl.

When the pressure roller 182 and the thermal roller 93 are compared, the thermal roller 93 has smaller curvature. Among the rollers 182 and 93, the thermal roller is heated to a higher temperature. Consequently, the sheet 60 receives curling of a degree which corresponds to the curvature of the thermal roller 93. Therefore, in case the curvature R2 of the correcting roller 184 is set less than the curvature R1 of the pressure roller 182, as described previously, the sheet 60 which has passed between the rollers 182 and 184 receives a curl of a degree corresponding to the curvature of the correcting roller 184.

When printing of image on only the front face in the case of duplex printing, the sheet 60 is transported from the fixing means 71*a* via the third guiding means 77*a* to the discharge path L4. At this time, the sheet 60 is transported with the front face whereon an image is printed facing the cleaner 74. The sheet 60 is transported through the discharge path L4 in the retransporting direction G. The sheet 60 receives curl of a shape conforming to the circumferential surface of the thermal roller 93. That is, the sheet 60 is transported to the discharge path L4 while being warped toward the front face side.

When the other edge of the sheet 60 has passed the third guiding means 77*a*, rotating direction of the roller of the second transporting means 76*a* is reversed. This causes the sheet 60 to be reversed to the opposite transporting direction thereby to be transported from the discharge path L4 to the retransport path L3. At this time, the edge which was the other edge on the upstream side in the transporting direction in the first and the second transport paths becomes the leading edge while passing through the paths L4 and L3.

The sheet 60 transported to the retransport path L3 passes between the correcting roller 184 and the pressure roller 182. At this time, the sheet 60 is transported through the third transport path L3 so that the face warping toward inside by the curl comes into contact with pressure roller 182. Therefore, when the sheet 60 passes between the pressure roller 182 and the correcting roller 184, the sheet 60 receives curl in the opposite direction the curl given by the rollers 93 and 182. Thus the curls cancel each other thereby eliminating the curl of the sheet 60. The sheet 60 with the curl having been eliminated is sent to the third transporting means 80. This makes it possible to send the sheet 60 without curl to the first transport path L1 when an image is printed on the back face of the sheet 60.

As a duplex printing apparatus of a fifth embodiment, such an apparatus can be conceived that only the rotary shaft 187 of the correcting roller 184 can make angular displacement in the direction of the arrow x. This apparatus has a similar configuration as those of the duplex printing apparatus 50 of the first through the fourth embodiments, and therefore identical component elements will be identified by identical numerals with description thereof omitted. In the duplex printing apparatus, the pressure roller is fixed. Therefore, contact pressure between the thermal roller 92 and the pressure roller 93 is fixed. Consequently, the correcting roller 184 is pressed against the pressure roller 92 with a contact pressure of such an intensity as can cause curl that can cancel out the curl given to the sheet 60 by the rollers 92 and 93. When passing between the correcting roller 184 and the pressure roller 92, the sheet 60 receives curl in the opposite direction to the curl given between the rollers 92, 93. Thus curl of the sheet 60 is canceled out so that straight sheet is transported.

Further as a duplex printing apparatus of sixth embodiment, an apparatus wherein the rotary shaft of the correcting roller 184 is fixed. In this apparatus, contact pressure between the pressure roller 92 and the correcting roller 184 does not change. Because the rollers 92, 93 are used in the fixing means 71, at least one of these rollers is heated. Therefore, the other roller which rotates in contact therewith also receives the transmitted heat thereby to be heated. When the sheet 60 passes between the two pairs of rollers having the same curvatures and heated to different temperatures, greater curl is given on the side of higher temperature.

Therefore, the ratio of curvatures between the rollers 93 and 184 is selected among the conditions described above, depending on the degree of the curl given to the sheet while passing between the pressure roller 92 and the thermal roller 93. In case the rollers 93, 184 having such a ratio of curvatures as described above are used, curl of the sheet 60 can be surely canceled out even when constitution such as the heating means and the spring means of the correcting roller 184 are omitted. Thus the configuration of the apparatus is made easier.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A duplex printing apparatus comprising:

sheet feeding means for housing a plurality of paper sheets so that a stack of the plurality of paper sheets is formed and feeding the uppermost paper sheet of the stack in a sheet feeding direction toward one side of the main body of the duplex printing apparatus when printing is started, the sheet feeding means being disposed at a lower part of the main body;

first guiding means for guiding the paper sheet fed by the sheet feeding means into a first transport path, the first guiding means being disposed at a position nearer to the one side of the main body and including a guiding plate in which a first guiding plane for inverting the sheet flow to a first transport direction opposite to the sheet feeding direction is formed along the first transport path and the top face of which extends along the first transport path;

second guiding means in which a second guiding plane is formed to guide the sheet which is inverted by the first guiding means and transported in the first transport direction, into a second transport path arranged substantially in parallel with the one side of the main body;

first transport means for transporting the sheet inverted by the first guiding means to the second guiding means, disposed in the first transport path;

developing and image transferring means for forming a toner image on one side of the sheet transported along the second transport path at an image transferring position;

fixing means for fixing the toner image formed on the one side of the sheet, disposed in the second transport path and arranged above the image transferring position;

third guiding means arranged above the fixing means and having a third guiding plane which guides the sheet transported from the fixing means along the second transport path, in a sheet discharging direction opposite to the sheet feeding direction along a sheet discharging path connected to a sheet discharging port formed in an upper part of the main body;

second transport means disposed in the sheet discharging path on the downstream side of the third guiding means in the sheet discharging direction and having a first drive roller which is driven to rotate selectively in either a first rotating direction corresponding to the sheet discharging direction or a second rotating direction opposite to the first rotating direction and a driven roller which is in contact with the first drive roller to be driven to rotate;

a rotation drive source for driving the first drive roller to rotate selectively in either the first rotating direction or the second rotating direction;

fourth guiding means for guiding the sheet which is transported by the second transport means from the sheet discharging path over the third guiding means in the refeeding direction opposite to the sheet discharging direction, into a third transport path provided substantially in parallel with the second transport path and nearer to the one side of the main body than the second transport path; and fifth guiding means for guiding the sheet which is transported along the third transport path in a third transport direction opposite to the second transport direction along the second transport path, into a direction which is inclined downward and for transporting the sheet to the first transport path.

2. The duplex printing apparatus of claim 1, wherein the third guiding means is disposed above the fixing means and includes an oscillating piece which is angularly displaced by being pressed against a sheet transported from the fixing means along the second transport path, and a support member for supporting the oscillating piece, the third guiding plane is formed on the oscillating piece, the support member supports from below the vicinity of the end of the oscillating piece on the downstream side in the discharging direction along the third guiding plane, an oscillating piece detecting means for detecting the angular displacement of the oscillating piece is further provided, and the first drive roller of the second transport means is driven to rotate selectively in either the first rotating direction or the second rotating direction in response to an output of the oscillating piece detecting means.

3. The duplex printing apparatus of claim 2, wherein the oscillating piece detecting means derives a first signal only when the oscillating piece is angularly displaced by being pressed against a sheet, and otherwise derives a second signal, the duplex printing apparatus further comprising:

mode selecting means for selecting one mode from between duplex printing mode wherein toner images are formed and fixed on one side and the other side of a sheet, and simplex printing mode wherein a toner image is formed and fixed on only one side of a sheet, and outputs a duplex mode signal when duplex printing mode is selected and outputting a simplex mode signal when the simplex printing mode is selected; and control means for responding to outputs of the mode selecting means and the oscillating piece detecting means and controlling the feeding means, the first and second transport means, the developing and image transfer means, and the fixing means, wherein in case the duplex mode signal is given, sheets are fed to the first transport path every predetermined first sheet feed period by the sheet feeding means, the sheet which has been transported to the first transport path is transported to the second transport path by the first transport means, while the sheet is being transported through the second transport path, a first toner image is formed on one side of the sheet by the developing and image transferring means and further fixed by the fixing means, then, when the output of the oscillating piece detecting means is switched from the second signal to the first signal, the first drive roller of the second transport means is driven to rotate in the first rotating direction to transport the sheet which has been guided into the discharge path in the discharging direction, after the lapse of a predetermined transport time since the output of the oscillating piece detecting means was switched from the first signal to the second signal, the rotating direction of the first drive roller is switched to the second rotation direction to transport the sheet to the third transport path, the sheet transported from the third transport path to the first transport path is transported again to the second transport path by the first transport means, while the sheet is being transported through the second transport path, a second toner image is formed on the other side of the sheet by the developing and image transferring means and further fixed by the fixing means, and when the output of the oscillating piece detecting means is switched from the second signal to the first signal, the first drive roller of the second transport means is driven to rotate in the first rotating direction to transport in the discharging direction the sheet guided into the discharging path by the third guiding means and thereby discharge the sheet to the outside, and in case the simplex mode signal is given, sheets are fed to the first transport path every predetermined second sheet feed period shorter than the first speed feeding period by the sheet feeding means, the sheet which has been transported to the first transport path is transported to the second transport path by the first transport means, while the sheet is being transported through the second transport path, a first toner image is formed on one side of the sheet by the developing and image transferring means and further fixed by the fixing means, and when the output of the oscillating piece detecting means is switched from the second signal to the first signal, the first drive roller of the second transport means is driven to rotate in the first rotating direction to transport in the discharging direction the sheet guided into the discharging path by the third guiding means and thereby discharge the sheet to the outside.

4. The duplex printing apparatus of claim 3, wherein the developing and image transferring means of the invention repeats the operation for forming a toner image on one side of a sheet plural times, and in case the simplex mode signal is given from the mode selecting means during printing of toner images on the sheet in the duplex printing mode, the control means controls the feeding means to feed the first sheet on which a toner image is to be printed in the simplex printing mode after the lapse of the first sheet feeding period since the last sheet whereon the toner image is to be printed in the duplex printing mode was fed into the first transport path, and thereafter feed sheets into the first transport path every second sheet feeding period.

5. The duplex printing apparatus of claim 3, wherein developing and image transferring means of the invention repeats the operation for forming a toner image on one side of sheets plural times, and in case the duplex mode signal is given from the mode selecting means during printing of toner image on the sheet in the simplex printing mode, the control means controls the feeding means to feed the first sheet on which a toner image is to be printed in the duplex printing mode after the lapse of the second sheet feeding period since the last sheet whereon the toner image is to be printed in the simplex printing mode was fed into the first transport path, and thereafter feed sheets into the first transport path every first feeding period.

6. The duplex printing apparatus of claim 3, further comprising:

print interrupting means for outputting a print interrupt signal to the control means for interrupting the printing of a toner image on a sheet, wherein when the print interrupt signal is given from the print interrupting means, the control means responds to the print interrupting signal to stop the forming and fixing of the toner image in the developing and image transferring means and the fixing means and lets the first and the second transporting means transport sheets existing in the first through third transport paths toward the third direction, the first transport direction and the discharging direction, respectively, thereby to discharge the sheets from the discharging paths to the outside of the apparatus.

7. The duplex printing apparatus of claim 3, further comprising:

data supplying means for supplying image signals including image data of a toner image to be formed on one or the other side of a sheet, which are image data of toner images of pages 1 through N (N is an integer not less than 3 to the developing and image transferring means, and causing the mode selecting means to output a duplex mode signal before printing of the toner image is started, wherein the control means controls the feeding means to transport the 1st through (N/2)th sheets successively into the first transport path and the developing and image transfer means to form the toner image of page 2n as the first toner image on one side of the nth (n=1, 2, . . . N/2) sheet and to form the toner image of page (2n−1) as the second toner image on the other side of the sheet.

8. The duplex printing apparatus of claim 1, wherein the fixing means includes a pressure roller installed on the third transport path side of the second transport path and a thermal roller to be heated to a predetermined fixing temperature, installed on the opposite side of the second transport path from the pressure roller, and correcting means is provided, which has a second drive roller installed at a position which is in proximity to the fixing means and on the side of the one side of the main body of the third transport path, and a plurality of first correcting rollers contacting with the second drive roller installed on the fixing means side of the third transport path.

9. The duplex printing apparatus of claim 1, wherein the fixing means includes a pressure roller installed on the third transport path side of the second transport path and a thermal roller to be heated to a predetermined fixing temperature installed on the opposite side of the second transport path from the pressure roller, and the first drive roller of the second transport means is installed at an upper position with respect to the sheet discharge path, and a plurality of driven rollers are installed to come into contact with the first drive roller from below.

10. The duplex printing apparatus of claim 1, wherein the fixing means includes a pressure roller installed on the third transport path side of the second transport path or on the opposite side of the second transport path from the third transport path and a thermal roller to be heated to a predetermined fixing temperature installed on the opposite side of the second transport path from the pressure roller, and correcting means is further provided, which has a correcting roller installed on the side of the one side of the main body of the third transport path, and holding means for holding the correcting roller, bringing the correcting roller into contact with the roller of the fixing means installed on the third transport path side of the second transport path and driving the correcting roller to rotate.

11. The duplex printing apparatus of claim 10, wherein the holding means further includes adjusting means for pressing the correcting roller in the direction of coming into contact with the roller of the fixing means, installed on the third transport path side of the second transport path, and adjusting the contact pressure between the correcting roller and the roller of the fixing means, installed on the third transport path side of the second transport path.

12. The duplex printing apparatus of claim 10, wherein the correcting means further includes heating means for heating the correcting roller to a predetermined temperature.

13. The duplex printing apparatus of claim 10, wherein the correcting means further includes a cleaning roller for removing foreign matters sticking onto the correcting roller by being brought into contact with the correcting roller and being driven to rotate.

14. The duplex printing apparatus of any one of claims 1,2 and 8–13, further comprising:

third transport means provided with a third drive roller installed in the third transport path, which is driven by the rotation drive source to rotate in a third rotation direction corresponding to the third transport direction, while to which the rotation drive force in the opposite direction to the third rotation direction is shut off.

15. The duplex printing apparatus of any one of claims 1, 2 and 8–13, further comprising:

third transport means provided with a third drive roller installed in the third transport path, which is driven by the rotation drive source to rotate in a third rotation direction corresponding to the third transport direction, while to which the rotation drive force in the opposite direction to the third rotation direction is shut off; and further, wherein a manual sheet feeding port opening toward the outside is provided at a position in the one side of the main body, facing to the first transport direction, the fifth guiding means includes:

a lower oscillating member having a base portion pivoted so as to freely oscillate at an interval upward from the top surface of the guiding plate of the first guiding means, and a suspended portion extending from the base portion in a direction of approaching the top surface;

an upper oscillating member having a fixed end pivoted over the lower oscillating member so as to freely oscillate about an axial line parallel to the lower oscillating member and a free end formed near an upper part of the lower oscillating member; and means for energizing the upper oscillating member in such a direction that the free end thereof approaches the third transport path, a contact surface facing the free end of the upper oscillating member is formed above the lower oscillating member, and an arc-shaped support surface is formed at the free end of the upper oscillating member.

16. The duplex printing apparatus of any one of claims 1, 2 and 8–13, further comprising:

third transport means provided with a third drive roller installed in the third transport path, which is driven by the rotation drive source to rotate in a third rotation direction corresponding to the third transport direction, while to which the rotation drive force in the opposite direction to the third rotation direction is shut off; further, wherein a manual sheet feeding port opening toward the outside is provided at a position in the one side of the main body, facing to the first transport direction, the fifth guiding means includes:

a lower oscillating member having a base portion pivoted so as to freely oscillate at an interval upward from the top surface of the guiding plate of the first guiding means, and a suspended portion extending from the base portion in a direction of approaching the top surface;

an upper oscillating member having a fixed end pivoted over the lower oscillating member so as to freely oscillate about an axial line parallel to the lower oscillating member and a free end formed near an upper part of the lower oscillating member; and means for energizing the upper oscillating member in such a direction that the free end thereof approaches the third transport path, a contact surface facing the free end of the upper oscillating member is formed above the lower oscillating member, and an arc-shaped support surface is formed at the free end of the upper oscillating member; and wherein sheet feed detecting means if provided, which has an actuation piece which freely retracts and projects above the guiding plate and is installed on an upstream side of the first transport means in the first transport direction, and outputs a sheet feed detection signal in response to tilting of the actuation piece.

* * * * *